US006941092B2

(12) United States Patent
Yokoi

(10) Patent No.: US 6,941,092 B2
(45) Date of Patent: Sep. 6, 2005

(54) REMANUFACTURING METHOD FOR PROCESS CARTRIDGE

(75) Inventor: Akiyoshi Yokoi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 46 days.

(21) Appl. No.: 10/697,323

(22) Filed: Oct. 31, 2003

(65) Prior Publication Data

US 2004/0091282 A1 May 13, 2004

(30) Foreign Application Priority Data

Nov. 6, 2002 (JP) ..... 2002-322159

(51) Int. Cl.[7] ..... G03G 15/00
(52) U.S. Cl. ..... 399/109
(58) Field of Search ..... 399/24, 25, 26, 399/27, 107, 109, 110, 111, 113

(56) References Cited

U.S. PATENT DOCUMENTS

| | | | | | |
|---|---|---|---|---|---|
| 5,729,795 | A | * | 3/1998 | Kavolius et al. | 399/109 |
| 5,940,658 | A | | 8/1999 | Yokoi et al. | 399/119 |
| 6,006,058 | A | | 12/1999 | Watanabe et al. | 399/167 |
| 6,016,413 | A | | 1/2000 | Yokoyama et al. | 399/113 |
| 6,029,032 | A | | 2/2000 | Watanabe et al. | 399/111 |
| 6,141,513 | A | * | 10/2000 | Nishiuwatoko et al. | 399/109 |
| 6,169,866 | B1 | | 1/2001 | Watanabe et al. | 399/111 |
| 6,236,821 | B1 | | 5/2001 | Yokoyama et al. | 399/113 |
| 6,246,848 | B1 | | 6/2001 | Morinaga et al. | 399/106 |
| 6,246,849 | B1 | | 6/2001 | Yokoyama et al. | 399/117 |
| 6,253,036 | B1 | | 6/2001 | Karakama et al. | 399/27 |
| 6,289,189 | B1 | | 9/2001 | Numagami et al. | 399/111 |
| 6,330,409 | B1 | | 12/2001 | Watanabe et al. | 399/111 |
| 6,442,359 | B1 | | 8/2002 | Numagami et al. | 399/111 |
| 6,463,223 | B1 | | 10/2002 | Karakama et al. | 399/27 |
| 6,463,233 | B2 | | 10/2002 | Kojima et al. | 399/111 |
| 6,571,070 | B2 | | 5/2003 | Oguma et al. | 399/27 |
| 6,577,831 | B1 | | 6/2003 | Kojima et al. | 399/111 |
| 6,587,650 | B2 | | 7/2003 | Yokoi et al. | 399/27 |
| 6,608,980 | B2 | | 8/2003 | Murayama et al. | 399/111 |
| 6,625,413 | B2 | | 9/2003 | Oguma et al. | 399/222 |
| 6,658,224 | B2 | | 12/2003 | Yokoi et al. | 399/113 |
| 6,754,460 | B2 | * | 6/2004 | Lewis et al. | 399/109 |
| 2001/0036373 | A1 | * | 11/2001 | Higeta et al. | 399/109 |
| 2001/0038758 | A1 | | 11/2001 | Oguma et al. | 399/27 |
| 2002/0037179 | A1 | | 3/2002 | Suzuki et al. | 399/111 |
| 2002/0057924 | A1 | | 5/2002 | Ueno et al. | 399/117 |
| 2002/0057928 | A1 | | 5/2002 | Yasumoto et al. | 399/167 |
| 2002/0085854 | A1 | | 7/2002 | Numagami et al. | 399/90 |
| 2002/0131789 | A1 | | 9/2002 | Yokoi et al. | 399/103 |
| 2002/0131791 | A1 | | 9/2002 | Yokoi et al. | 399/113 |
| 2002/0141788 | A1 | | 10/2002 | Matsuda et al. | 399/260 |
| 2002/0159788 | A1 | * | 10/2002 | Miyabe et al. | 399/109 |
| 2002/0172521 | A1 | | 11/2002 | Oguma et al. | 399/27 |
| 2003/0049036 | A1 | | 3/2003 | Ueno et al. | 399/25 |
| 2003/0108358 | A1 | | 6/2003 | Yokoi et al. | 399/109 |
| 2003/0113131 | A1 | | 6/2003 | Watanabe et al. | 399/111 |
| 2003/0133723 | A1 | | 7/2003 | Fujita et al. | 399/111 |
| 2003/0161644 | A1 | | 8/2003 | Yokoi et al. | 399/27 |
| 2003/0161657 | A1 | | 8/2003 | Yokoi et al. | 399/119 |
| 2003/0175050 | A1 | | 9/2003 | Murayama et al. | 399/256 |

* cited by examiner

*Primary Examiner*—Sandra L. Brase
(74) *Attorney, Agent, or Firm*—Fitzpatrick, Cella, Harper & Scinto

(57) ABSTRACT

A method of remanufacturing a process cartridge detachably attachable to an image forming apparatus main body, the method including: separating a first side cover from a developing unit and a photosensitive member unit; separating the photosensitive member unit from the developing unit by deforming a second side cover in a state where the second side cover and the developing unit are fixed to each other; detaching an electrophotographic photosensitive drum from the photosensitive member unit; attaching one of the electrophotographic photosensitive drum and a new photosensitive drum; engaging the developing unit with the second side cover that is fixed to the developing unit; and engaging the first side cover with respective end portions of the developing unit and the photosensitive member unit.

5 Claims, 17 Drawing Sheets

REMANUFACTURING METHOD FOR PROCESS CARTRIDGE

BACKGROUND OF THE INVENTION

1. Field of the Invention

The present invention relates to a remanufacturing method for a process cartridge that is detachably attachable to an electrophotographic image forming apparatus main body.

The term "process cartridge" referred to in this specification represents a cartridge, which is obtained by integrally combining at least developing means and an electrophotographic photosensitive member and is detachably attachable to the electrophotographic image forming apparatus main body.

2. Related Background Art

Up to now, image forming apparatuses using an electrophotographic image forming process have adopted a process cartridge system. In the process cartridge system, an electrophotographic photosensitive member and process means for acting on the electrophotographic photosensitive member are integrally combined into a cartridge, and the cartridge is detachably attachable to an electrophotographic image forming apparatus main body.

As a method of integrally combining the process means into a cartridge, a method of coupling a developing unit and a drum unit by using a molten resin has recently been proposed (see, for example, US Patent Application Publication No. 02-0037179) instead of a conventional coupling method in which the developing unit and the drum unit are supported by coupling frames (side covers) and coupled with each other by screws.

According to the process cartridge system, users themselves can perform the maintenance of apparatuses without the help of repair people, contributing to a remarkable improvement of operability. In view of this, the process cartridge system is broadly used for electrophotographic image forming apparatuses.

The process cartridge serves to form an image on a recording medium by use of a developer. As an image forming operation is repeated, the developer is consumed. When the developer is consumed to such an extent that an image to be formed can no longer ensure a quality high enough to satisfy a user who purchased the process cartridge, the commercial value of the process cartridge is lost. There is proposed a remanufacturing method capable of commercializing again the process cartridge in which the developer has been consumed and whose commercial value has been lost.

However, in order to remanufacture the process cartridge in which a part of a frame is joined to another member with a molten resin or the like, steps for separating junctions may be necessary.

SUMMARY OF THE INVENTION

The present invention has an object to provide a simplified remanufacturing method for a process cartridge.

Another object of the present invention is to provide a simplified remanufacturing method for a process cartridge in which structural components are joined to each other by a molten resin, the remanufacturing method including no process for separating the portions joined with the molten resin.

Still another object of the present invention is to provide a remanufacturing method for a process cartridge, the remanufacturing method being capable of commercializing again the process cartridge in which a developer has been consumed to an extent that an image to be formed can no longer ensure a quality high enough to satisfy a user and whose commercial value as the process cartridge has been lost.

Yet still another object of the present invention is to provide a remanufacturing method for a process cartridge detachably attached to an image forming apparatus main body, the process cartridge including:

a photosensitive member unit having an electrophotographic photosensitive drum on which an electrostatic latent image is formed;

a developing unit having:

a developer container for containing a developer for developing the electrostatic latent image; and a developing roller for carrying the developer;

a first coupling frame for coupling one end side of the photosensitive member unit and one end side of the developing unit to each other; and a second coupling frame for coupling the other end side of the photosensitive member unit and the other end side of the developing unit, which are opposite sides of the one end sides, to each other, the remanufacturing method including:

(a) a frame separating step for separating the first coupling frame from the developing unit and the photosensitive member unit;

(b) a photosensitive member unit separating step for, after the frame separating step, separating the photosensitive member unit by deforming the second coupling frame in a state where the second coupling frame and the developing unit are fixed to each other;

(c) a photosensitive drum detaching step for, after the photosensitive member unit separating step, detaching the electrophotographic photosensitive drum from the photosensitive member unit;

(d) a photosensitive drum attaching step for, after the photosensitive drum detaching step, attaching one of the electrophotographic photosensitive drum and a new photosensitive drum;

(e) a photosensitive member unit engaging step for engaging the photosensitive member unit with the second coupling frame that is fixed to the developing unit; and (f) a frame engaging step for engaging the first coupling frame with respective end portions of the developing unit and the photosensitive member unit.

These and other objects, features and advantages of the present invention will become more apparent upon consideration of the following description of the preferred embodiment of the present invention taken in conjunction with the accompanying drawings.

DESCRIPTION OF THE PREFERRED EMBODIMENT

Hereinafter, the accompanied drawings are referenced to describe in detail a preferred embodiment of the present invention by use of examples. Unless particular description is made, it is not intended to limit the scope of the present invention to dimensions, materials, shapes, relative positions, etc. of the structural components described in this embodiment. Also, the materials, shapes, etc. of members described for the first time are the same throughout this embodiment unless particular description is added.

<Description of Electrophotographic Image Forming Apparatus>

Figure 2:
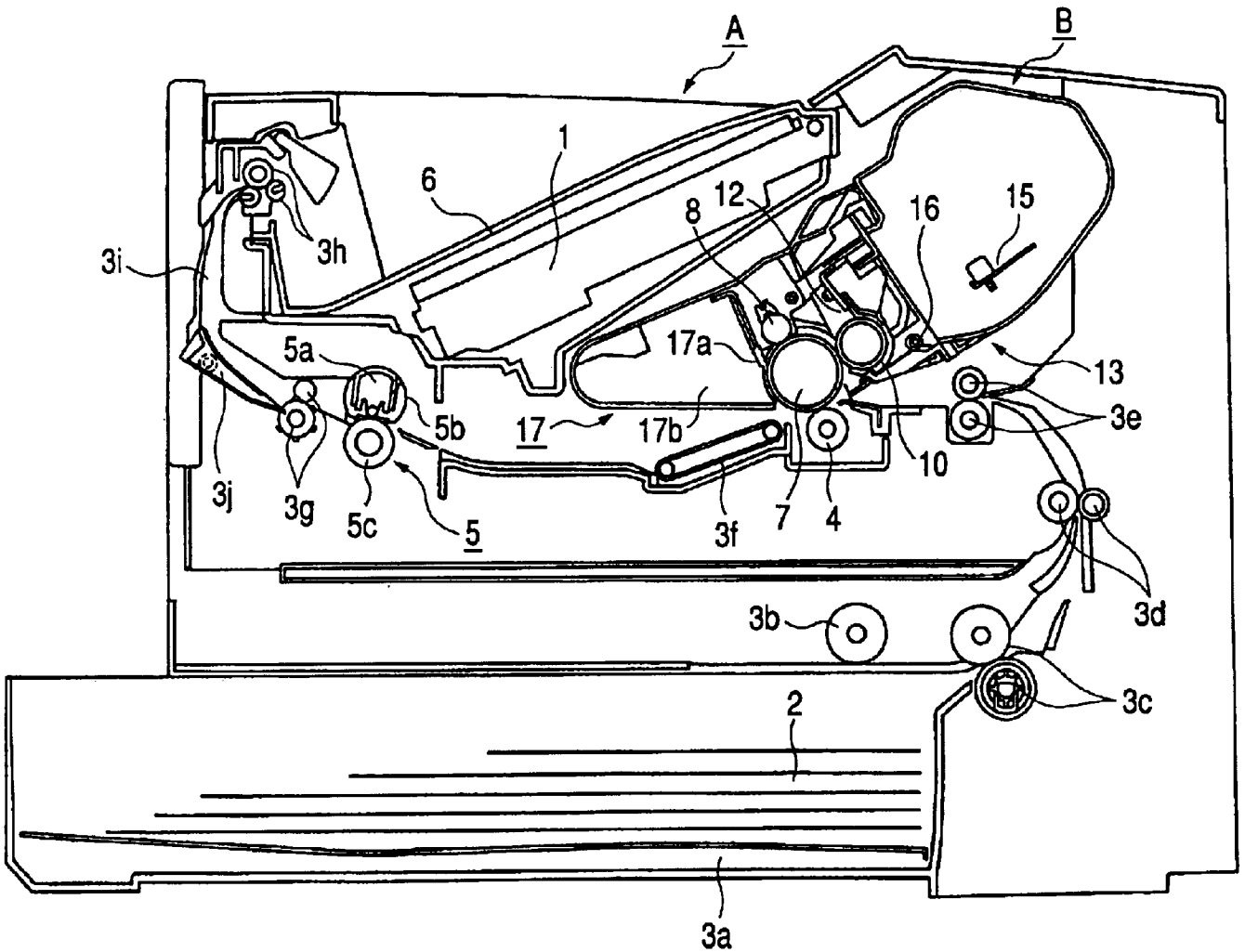
FIG. 2 is a schematic cross-sectional view of an electrophotographic image forming apparatus according to the embodiment of the present invention.
Figure 3:
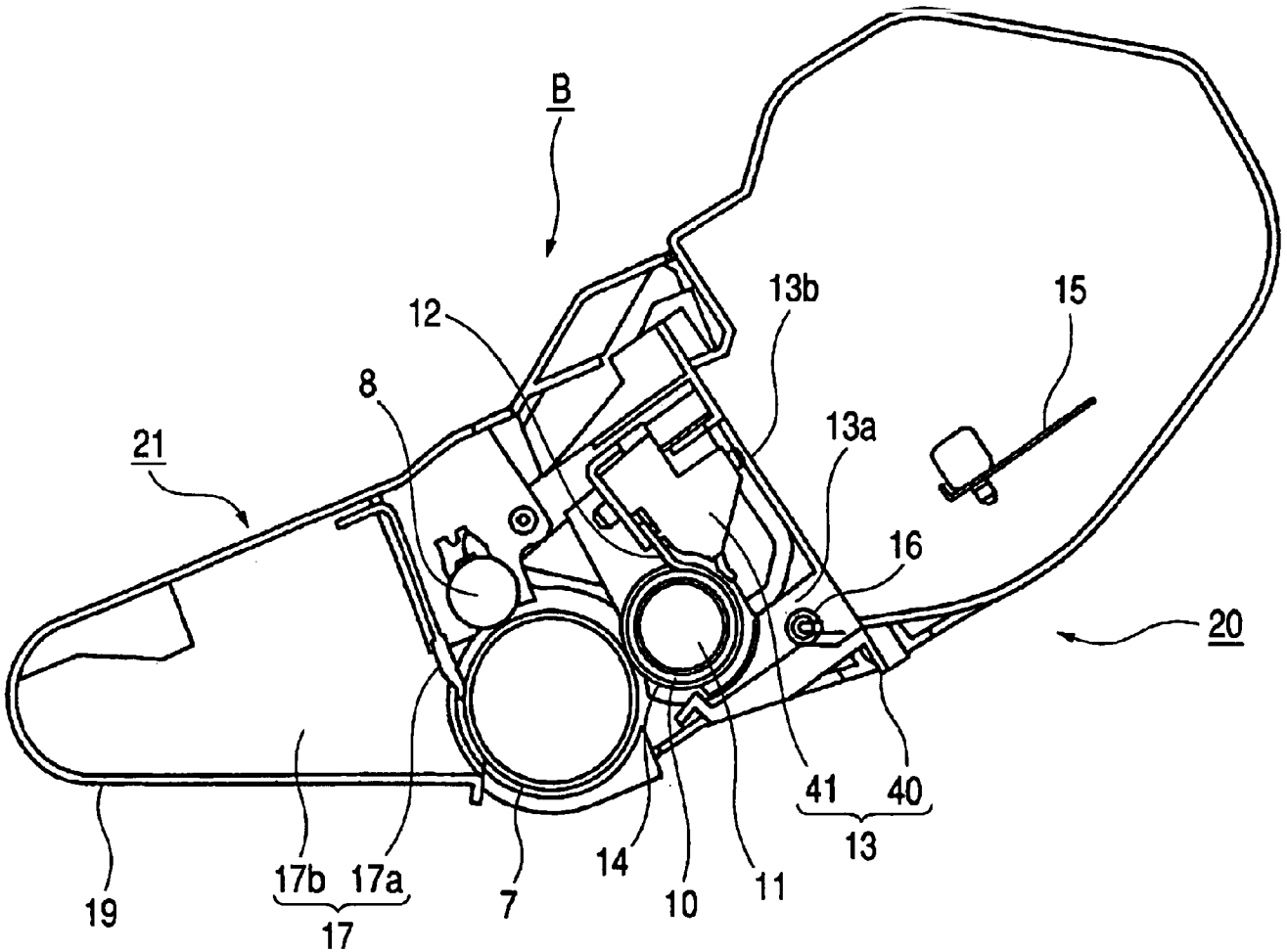
FIG. 3 is a schematic cross-sectional view of the process cartridge that is detachably attachable to the electrophotographic image forming apparatus according to the embodiment of the present invention.

First, FIGS. 2 and 3 are referenced to schematically describe overall structures of an electrophotographic image forming apparatus and a process cartridge that is detachably attachable thereto, respectively. FIG. 2 is a schematic cross-sectional view of the electrophotographic image forming apparatus according to the embodiment of the present invention, and more specifically a diagram for explaining an overall structure of a laser beam printer as a form of the electrophotographic image forming apparatus. FIG. 3 is a schematic cross-sectional view of the process cartridge that is detachably attachable to the electrophotographic image forming apparatus according to the embodiment of the present invention.

The electrophotographic image forming apparatus forms an image on a recording medium such as recording paper, a transparent film for an OHP, a cloth, or the like by use of an electrophotographic image forming process. Examples of the electrophotographic image forming apparatus include an electrophotographic copier, an electrophotographic printer (for example, an LED printer, the laser beam printer, or the like), an electrophotographic facsimile machine, and an electrophotographic word processor. In particular, this embodiment is described using the laser beam printer of an electrophotographic process as an example.

An image forming apparatus (laser beam printer) A according to this embodiment includes an electrophotographic photosensitive drum (hereinafter, simply referred to as "photosensitive drum") 7.

The photosensitive drum 7 is charged by a charging roller 8 as charging means. Then, laser beam light based on image information is emitted from optical means 1 including a laser diode, a polygon mirror, a lens, and a reflective mirror to form an electrostatic latent image corresponding to the image information on the photosensitive drum 7. The electrostatic latent image is developed using a developer (hereinafter, referred to as "toner") by developing means described later, thereby becoming a visualized image, that is, toner image.

Meanwhile, a recording medium 2 set in a sheet feeding cassette 3*a* is transported by means of a pickup roller 3*b* and transport roller pairs 3*c*, 3*d*, and 3*e* to reach a transfer position. At the transfer position, a transfer roller 4 as transfer means is disposed. By applying a voltage to the transfer roller 4, the toner image on the photosensitive drum 7 is transferred onto the recording medium 2.

The recording medium 2 onto which the toner image has been transferred is transported to fixing means 5 via a transport guide 3*f*. The fixing means 5 includes a drive roller 5*c* and a fixing roller 5*b* that has a heater 5*a* built therein, and applies heat and pressure to the recording medium 2 passing therethrough to fix the transferred toner image to the recording medium 2.

The recording medium 2 is transported by means of delivery roller pairs 3*g* and 3*h* via a sheet surface reverse path 3*i* to be delivered to a delivery tray 6. The delivery tray 6 is provided to an upper surface of the image forming apparatus A. Alternatively, by operating a flapper 3*j* capable of rocking, the recording medium 2 can be delivered without passing through the sheet surface reverse path 3*i*.

According to this embodiment, the pickup roller 3*b*, the transport roller pairs 3*c*, 3*d*, and 3*e*, the transport guide 3*f*, delivery roller pairs 3*g* and 3*h*, etc., comprise transport means.

After the toner image is transferred onto the recording medium 2 by the transfer roller 4, residual toner remaining on the photosensitive drum 7 is eliminated using cleaning means 17. Thus, the photosensitive drum 7 is prepared for the subsequent image forming process.

The cleaning means 17 uses an elastic cleaning blade 17*a* disposed in abutment with the photosensitive drum 7 to scrape off the residual toner from the photosensitive drum 7 so as to collect the residual toner into a waste toner reservoir 17*b*.

<Description of Process Cartridge>

Figure 4:
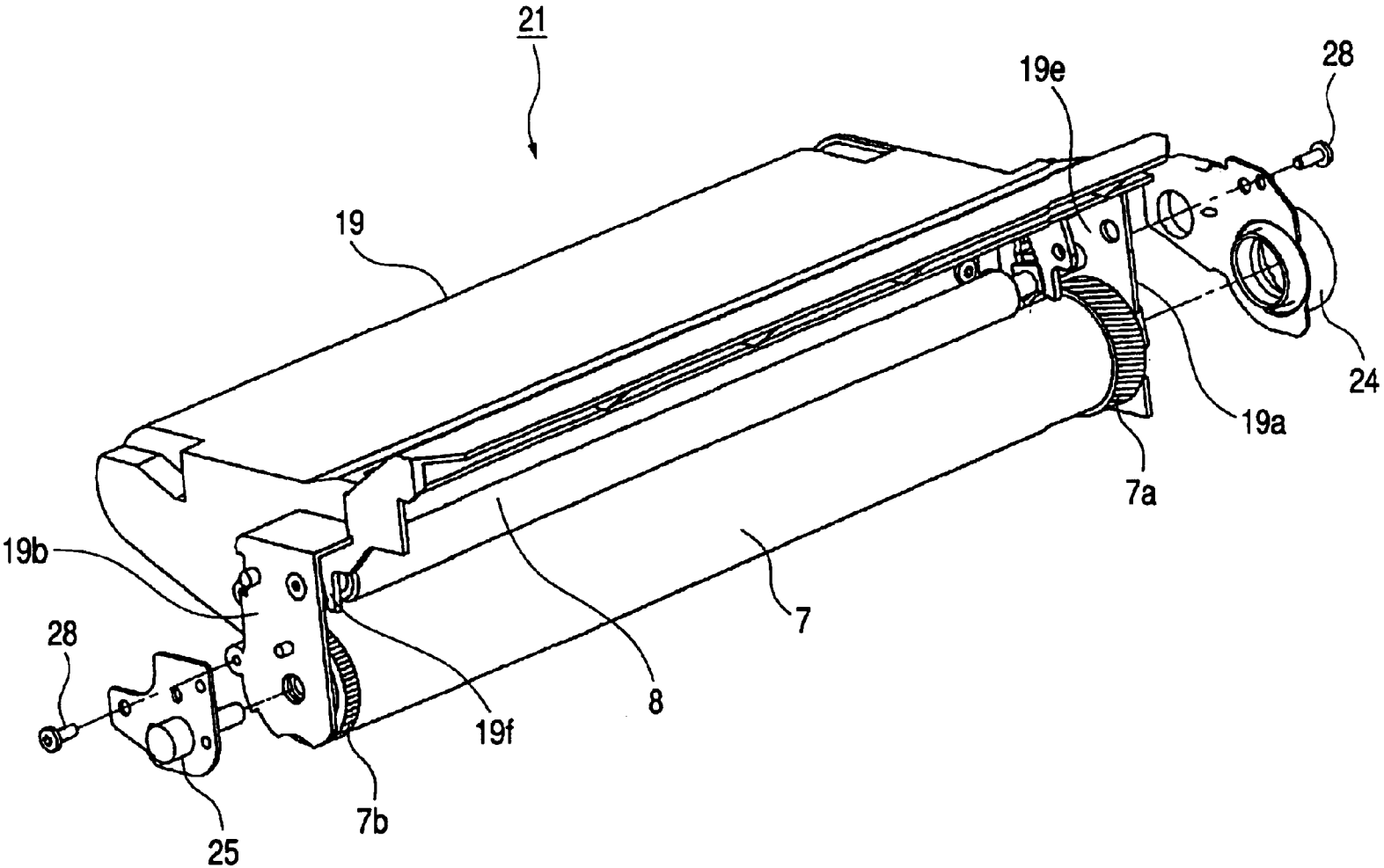
FIG. 4 is a perspective view showing a structure of the photosensitive member unit according to the embodiment of the present invention.
Figure 5:
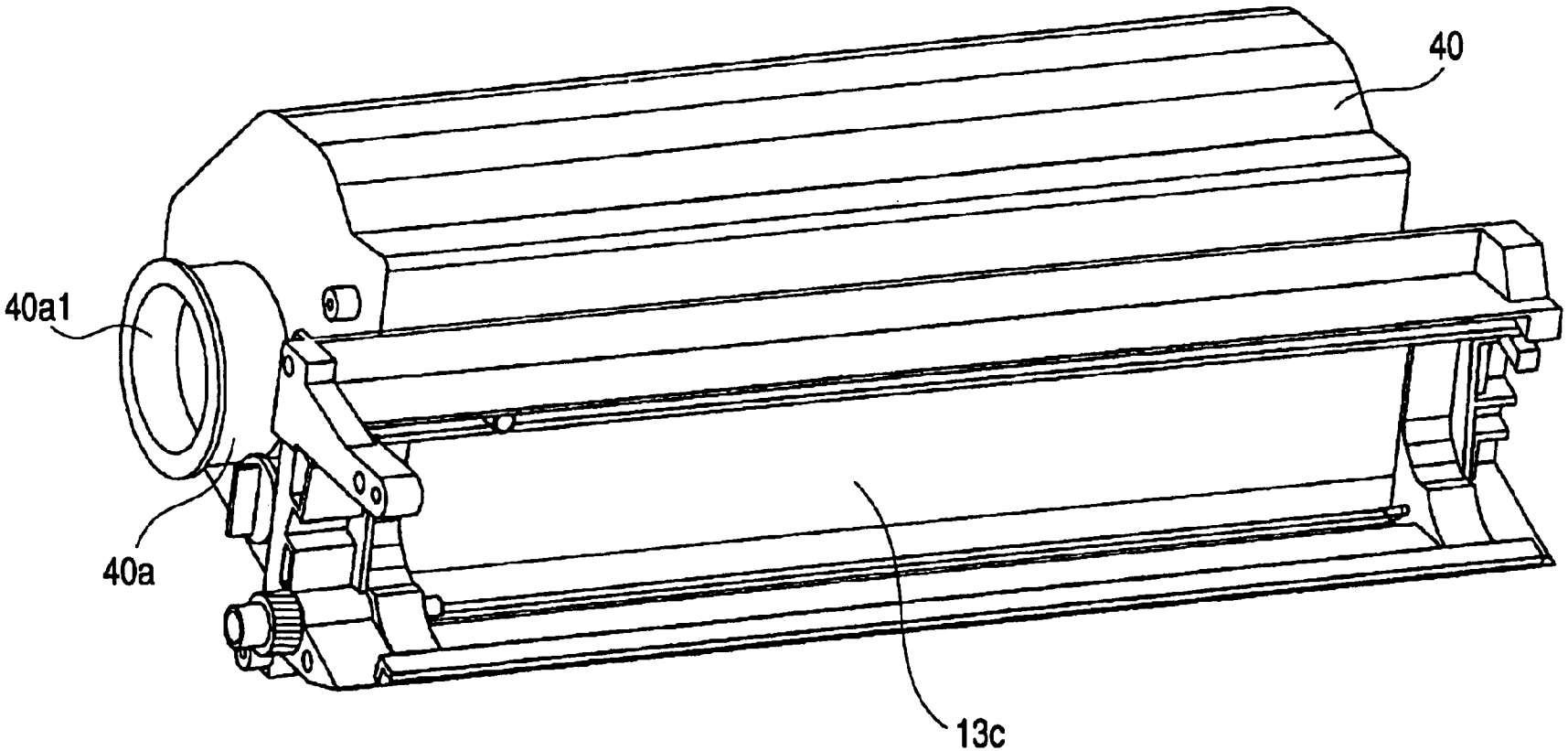
FIG. 5 is a perspective view showing a state where a developing roller is removed from a developing unit according to the embodiment of the present invention.
Figure 6:
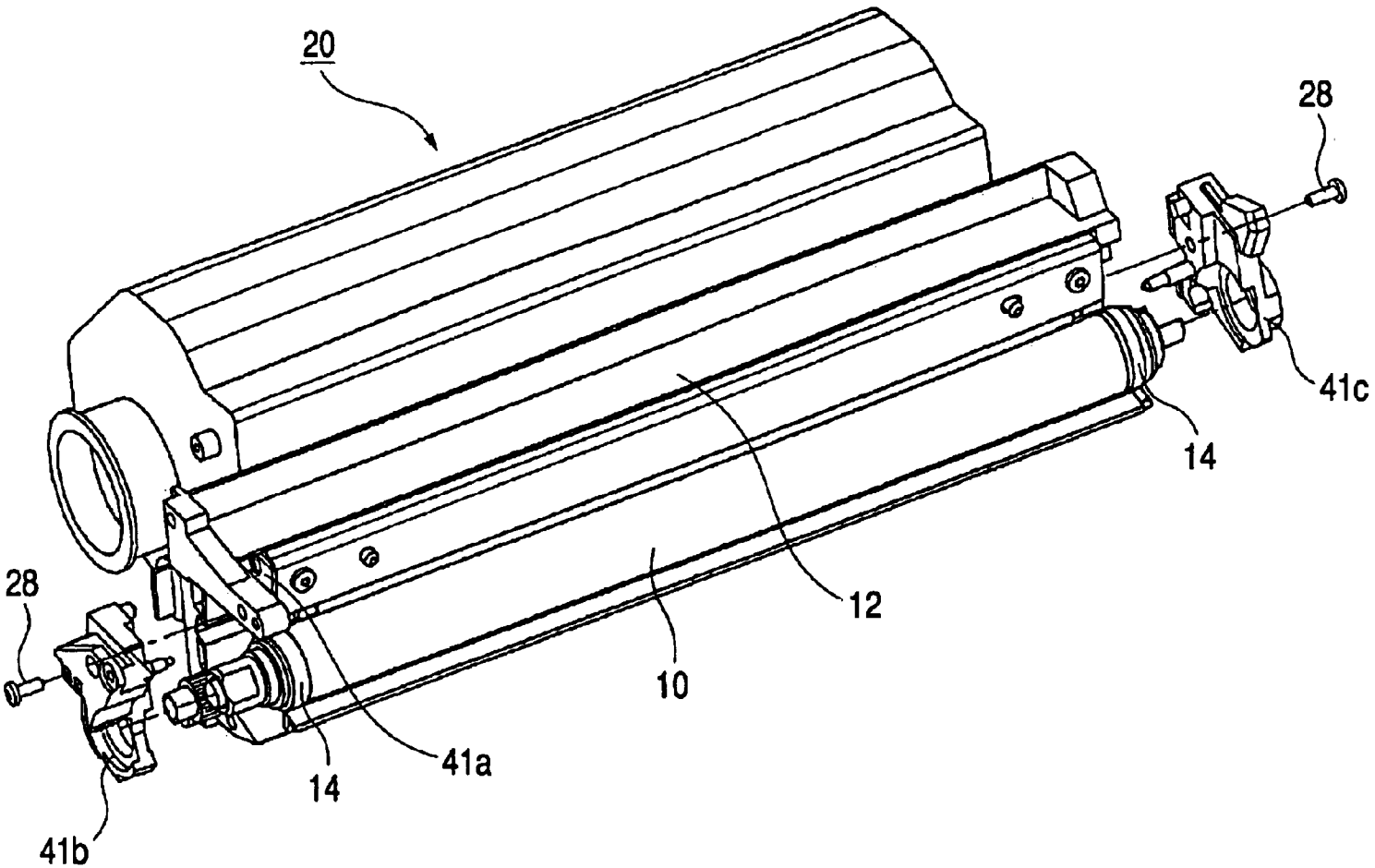
FIG. 6 is a perspective view showing a state where the developing unit is partially disassembled according to the embodiment of the present invention.
Figure 7:
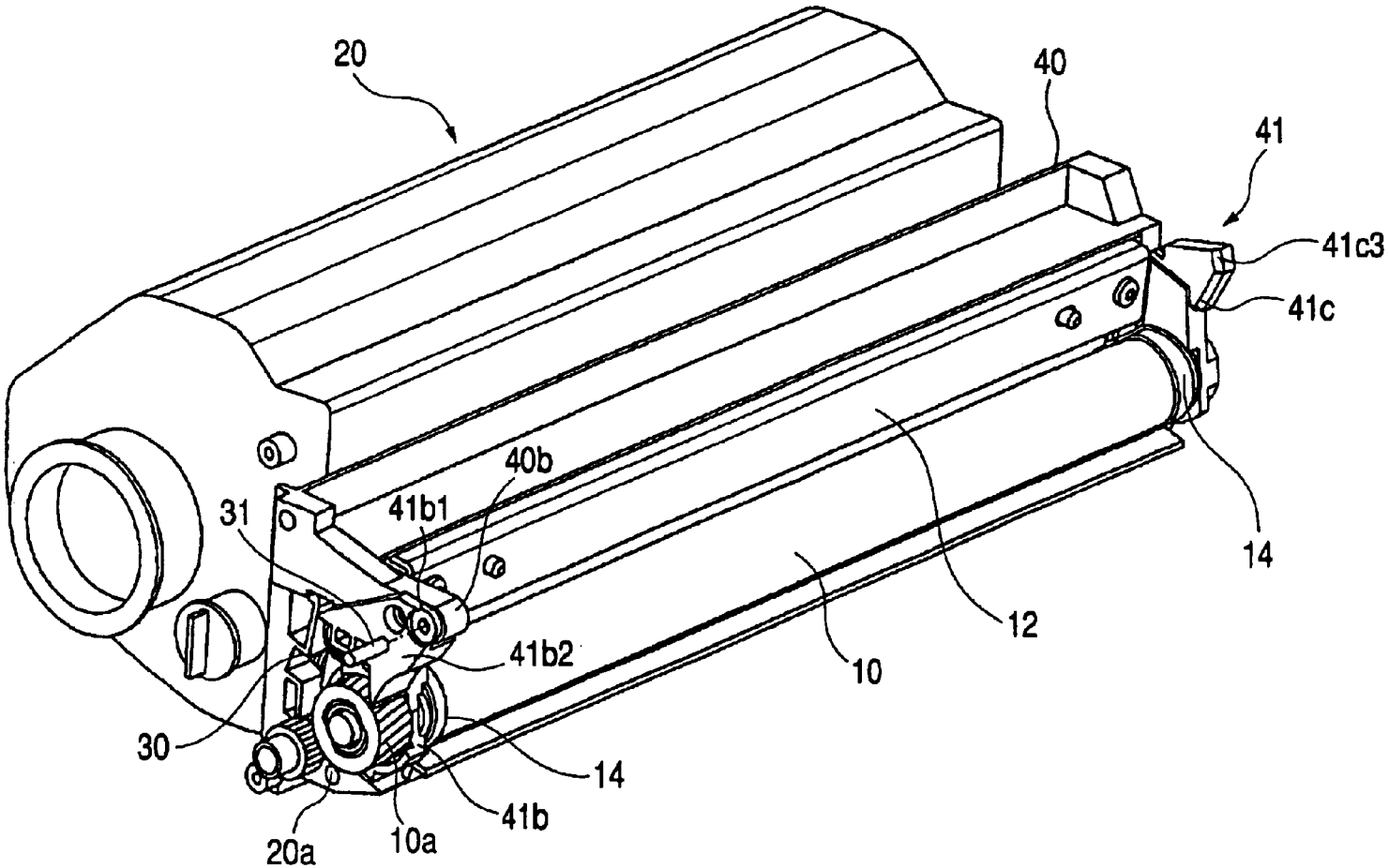
FIG. 7 is a perspective view showing a structure of the developing unit according to the embodiment of the present invention.

Next, a description will sequentially be provided of structures of respective members of the process cartridge according to the embodiment of the present invention. FIG. 4 is a perspective view of a photosensitive member unit according to the embodiment of the present invention. FIG. 5 is a perspective view showing a state where a developing roller is removed from a developing unit according to the embodiment of the present invention. FIG. 6 is a perspective view showing a state where the developing unit is partially disassembled according to the embodiment of the present invention. FIG. 7 is a perspective view of the developing unit according to the embodiment of the present invention.

(Photosensitive Member Unit)

As shown in FIGS. 3 and 4, the photosensitive drum 7, the charging roller 8, and the cleaning means 17 including the elastic cleaning blade 17*a* are attached to a drum frame 19, and integrally compose a photosensitive member unit 21.

The structure of FIG. 4 shows how the photosensitive drum 7 is attached to the drum frame 19. More specifically, gear flanges 7*a* and 7*b* are attached to both ends of the photosensitive drum 7, and the gear flange 7*a* is rotatably supported by a drum bearing 24. The gear flange 7*b* is rotatably supported to the drum frame 19 by a drum shaft 25. In addition, the drum bearing 24 and the drum shaft 25 are attached to side plates 19*a* and 19*b* of the drum frame 19 with a screw 28, respectively. Thus, the photosensitive drum 7 is incorporated into the photosensitive member unit 21.

When the gear flange 7*a* has its end portion connected to a rotating mechanism of an apparatus main body, a driving torque is imparted to the gear flange 7*a* from the apparatus main body. Then, a gear on an outer periphery of the gear flange 7*a* transmits a driving force to the developing roller 10 or the like. At the same time, a gear on an outer periphery of the gear flange 7*b* transmits a driving force to the transfer roller 4 or the like.

Further, as described later, guide portions 19*e* and 19*f* to be used at the time of coupling the photosensitive member unit 21 and the developing unit 20 are provided to inner sides of the side plates 19*a* and 19*b* of the drum frame 19, respectively.

(Developing Unit)

As shown in FIGS. 3 and 7, the developing unit 20 as the developing means of a cartridge B according to this embodiment is composed of a developing frame 13 that includes a toner containing frame 40 for containing toner and a moving frame 41 for holding a developing roller 10 and a developing blade 12.

By rotating a toner feeding member 15, the developing means sends toner inside the toner containing frame 40 to a developing chamber 13*a* through a toner supplying opening 13*b*. Then, the developing roller 10 having a magnet roller (fixed magnet) 11 built therein is rotated by a drive gear 10*a*. At the same time, a toner layer to which a triboelectrification charge is imparted by the developing blade 12 is formed on a surface of the developing roller 10.

The developing roller 10 is pressed against the photosensitive drum 7 by bias springs 30 (described later) while maintaining given clearances through spacer rollers 14. The developing roller 10 supplies the toner carried on its surface to a developing region of the photosensitive drum 7. The toner is transferred to the photosensitive drum 7 in accordance with the electrostatic latent image. Therefore, the toner image is formed on the photosensitive drum 7. Here, the developing blade 12 regulates a toner amount on a peripheral surface of the developing roller 10 and imparts a triboelectrification charge. In addition, a toner agitating member 16 for circulating the toner inside the developing chamber 13*a* is rotatably attached in the vicinity of the developing roller 10.

The toner supplying opening 13*b* of the toner containing frame 40 is sealed by a developer seal 13*c*. Also, after the toner containing frame 40 is filled with toner from the toner filling port 40*a*, the toner filling port 40*a* is stopped with a toner cap 40*a*1 to seal the toner containing frame 40, preventing the toner from leaking therefrom (see FIG. 5).

When using the cartridge B for the first time, a user pulls out the developer seal 13*c*, enabling the toner supply.

(Structure of Moving Frame)

Figure 8:
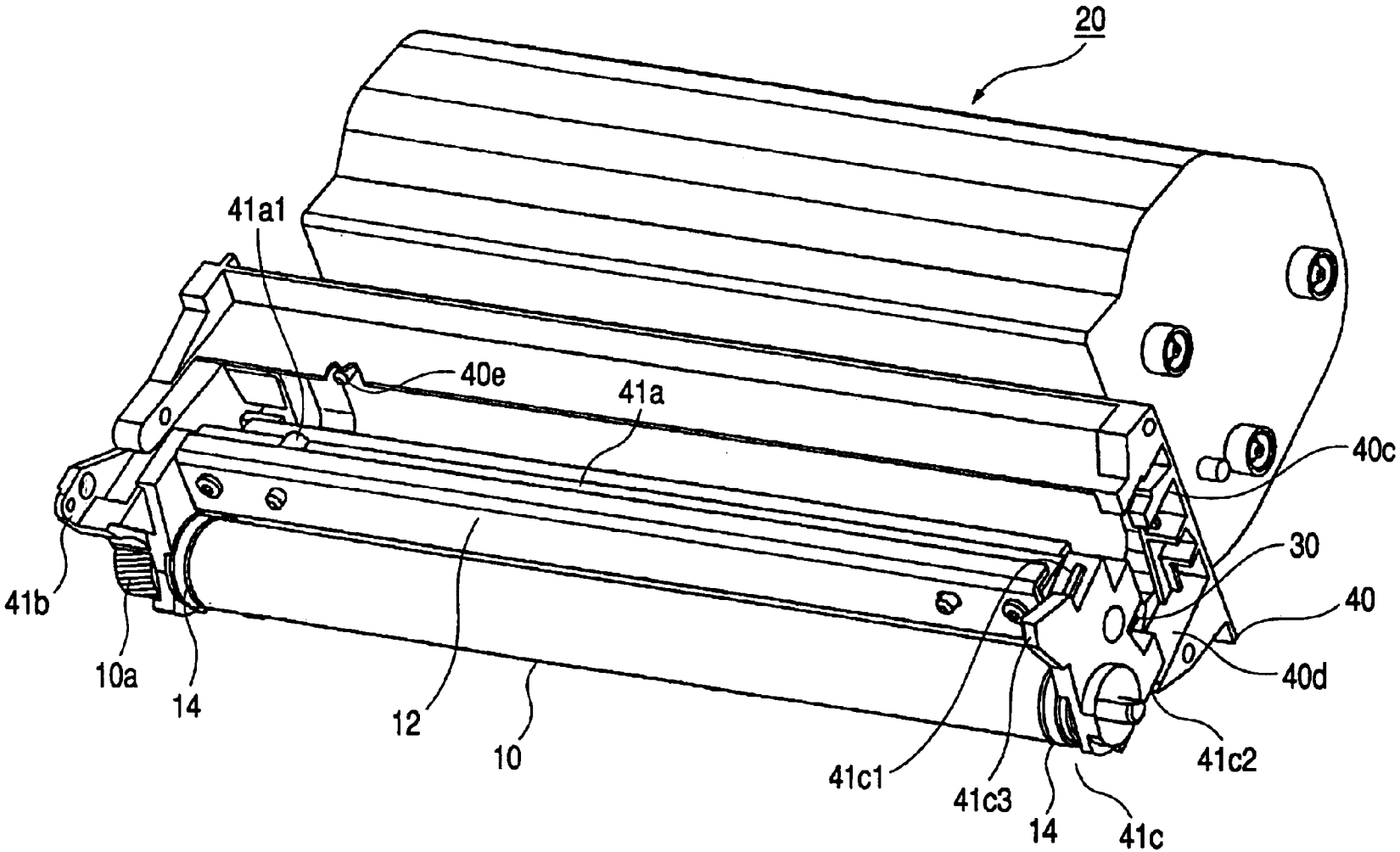
FIG. 8 is a perspective view showing a state where a part of structural components are removed from the developing unit according to the embodiment of the present invention.

Next, FIGS. 5 to 8 are referenced to describe a structure of the moving frame 41. FIG. 8 is a perspective view showing a state where a part of structural components are removed from the developing unit according to the embodiment of the present invention.

As shown in FIGS. 5 to 8, a first frame 41*a* of the moving frame 41 including the developing roller 10 and the developing blade 12 is incorporated into the toner containing frame 40 filled with toner. A second frame 41*b* and a third frame 41*c* are incorporated into the first frame 41*a* from both sides thereof and fixed thereto by screws. The developing roller 10 has both ends thereof pivotably supported by the second frame 41*b* and the third frame 41*c*. A positioning boss 40*e* and a positioning long-hole 41*a*1 are provided to the toner containing frame 40 and the first frame 41*a* of the moving frame 41, respectively. Thus, longitudinal positions of the moving frame 41 and the toner containing frame 40 are determined.

The spacer rollers 14 that are substantially concentric with the developing roller 10, each having an outer diameter larger than that of the developing roller 10 by a specified gap, are pivotably provided to both ends of the developing roller 10. In addition, as described above, the developing blade 12 serving as regulating means for regulating a thickness of the toner layer on the developing roller 10 is fixed to the first frame 41*a*. Also, the developing blade 12 has its forward end abutted against the developing roller 10.

As shown in FIG. 7, the second frame 41*b* of the moving frame 41 is provided with a rocking arm 41*b*2 having a rocking hole 41*b*1. The toner containing frame 40 is provided with a supporting arm 40*b* having a fixation hole coaxial with the rocking hole 41*b*1 on its end. The second frame 41*b* is engaged with the toner containing frame 40 by an engaging pin 31 so as to be capable of rocking. The engaging pin 31 is slidably loose-fitted into the rocking hole 41*b*1 of the second frame 41*b*. Meanwhile, the engaging pin 31 is forced into the fixation hole of the toner containing frame 40 to a close-fit.

As shown in FIG. 8, slide planes 41*c*1 and 41*c*2 for defining a sliding direction are provided in parallel substantially on an upper surface and a lower surface of the third frame 41*c* of the moving frame 41, respectively. Meanwhile, when placing the moving frame 41 inside the toner containing frame 40, guide planes 40*c* and 40*d* are provided so as to oppose the slide planes 41*c*1 and 41*c*2 of the third frame 41*c*, respectively, with minute clearances. The slide planes 41*c*1 and 41*c*2 and the guide planes 40*c* and 40*d* enable the third frame 41*c* to slide in a predetermined direction. In addition, provided in an end portion of the third frame 41*c* on a photosensitive member unit 21 side is a guide rib 41*c*3 to be used when coupling the photosensitive member unit 21 and the developing unit 20 as described later.

The bias springs 30 are disposed between the toner containing frame 40, and the second frame 41*b* and the third frame 41*c*. Therefore, the developing roller 10 held by the moving frame 41 is pressed against the photosensitive drum 7 while maintaining given clearances through spacer rollers 14.

(Coupling of Photosensitive Member Unit with Developing Unit)

The cartridge B is structured such that the photosensitive member unit 21 and the developing unit 20 which are structured as described above are integrally coupled with each other.

Figure 9:
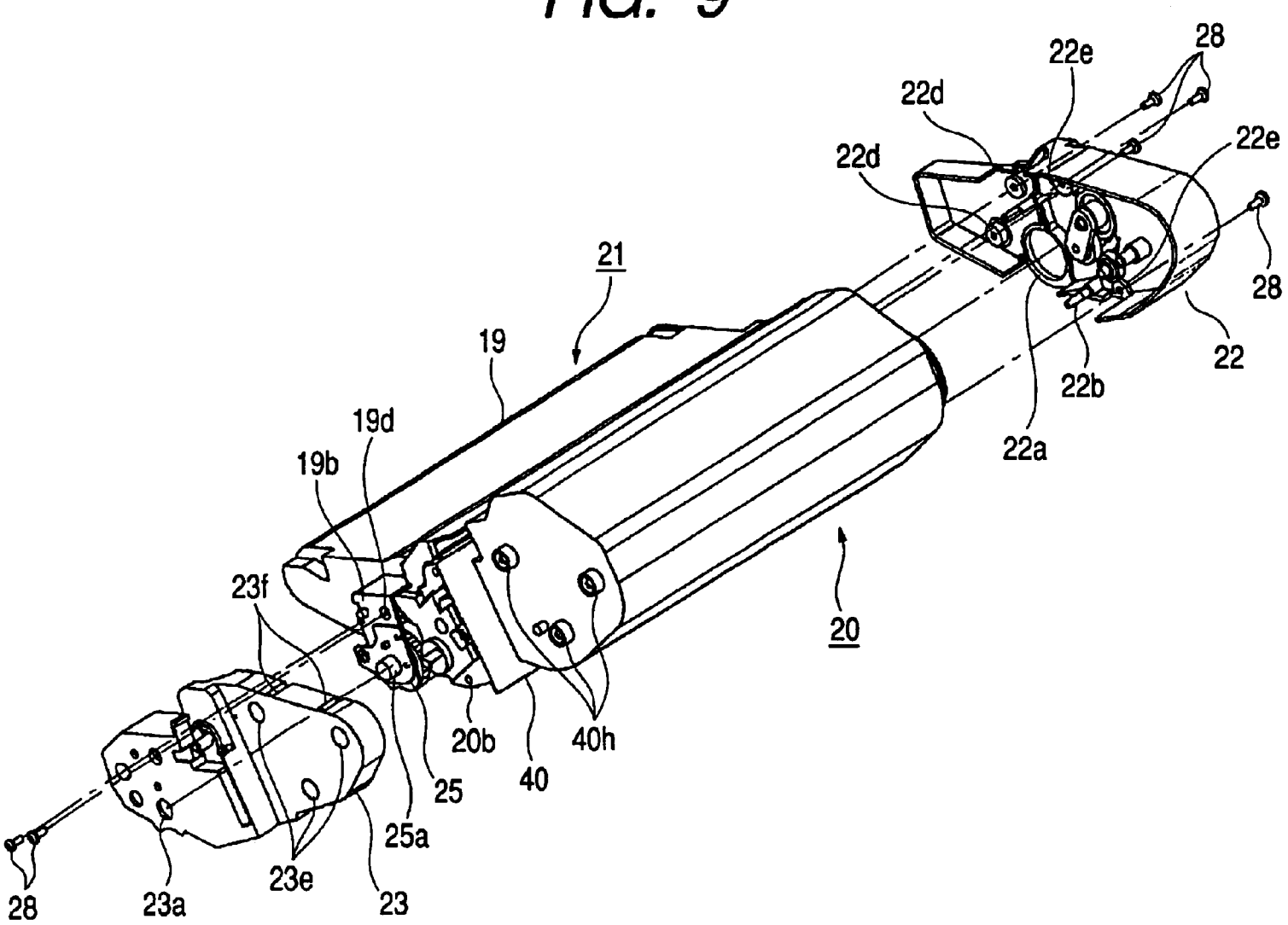
FIG. 9 is an exploded perspective view showing how side covers are attached to the process cartridge according to the embodiment of the present invention.
Figure 10:
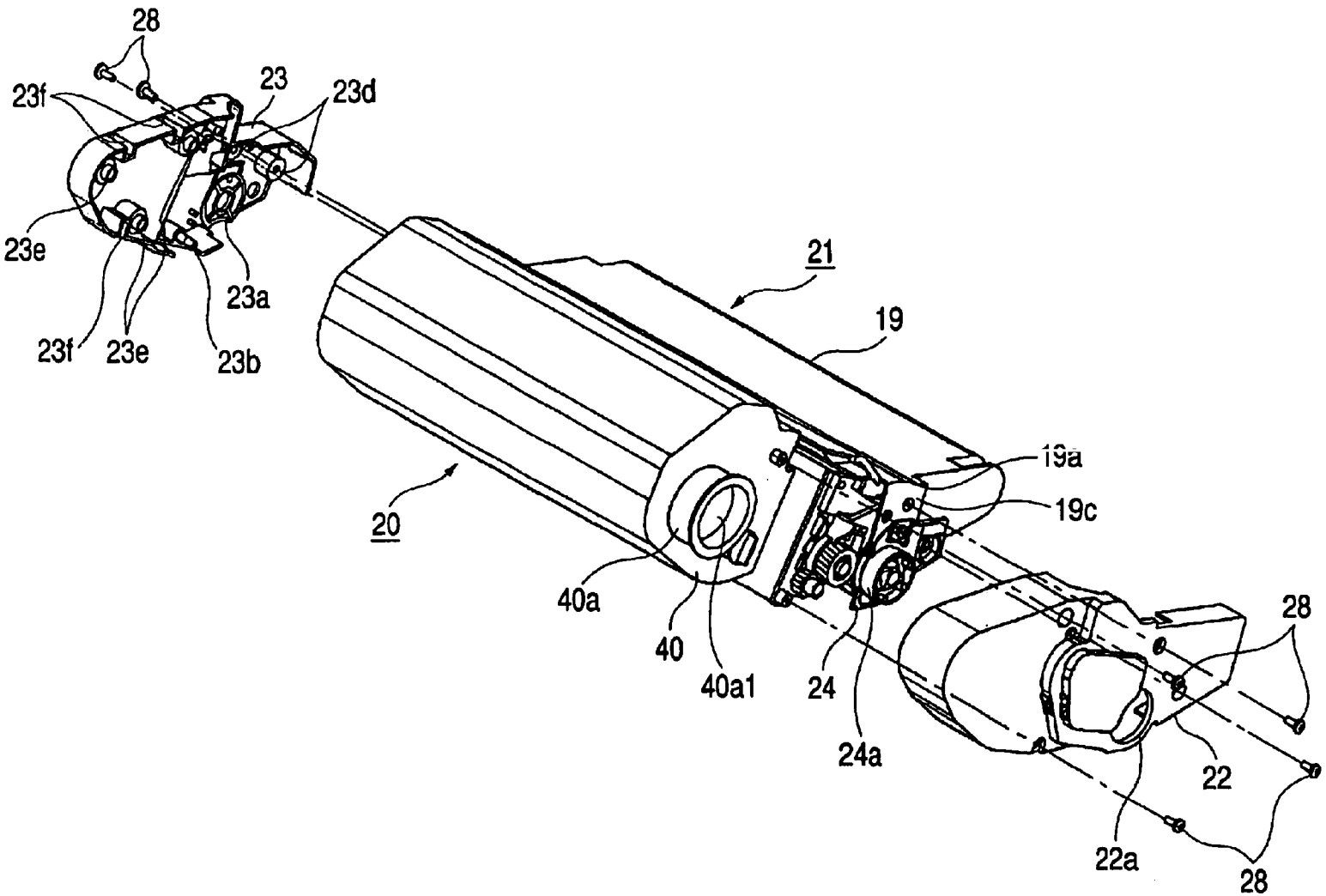
FIG. 10 is an exploded perspective view showing how the side covers are attached to the process cartridge according to the embodiment of the present invention.
Figure 11:
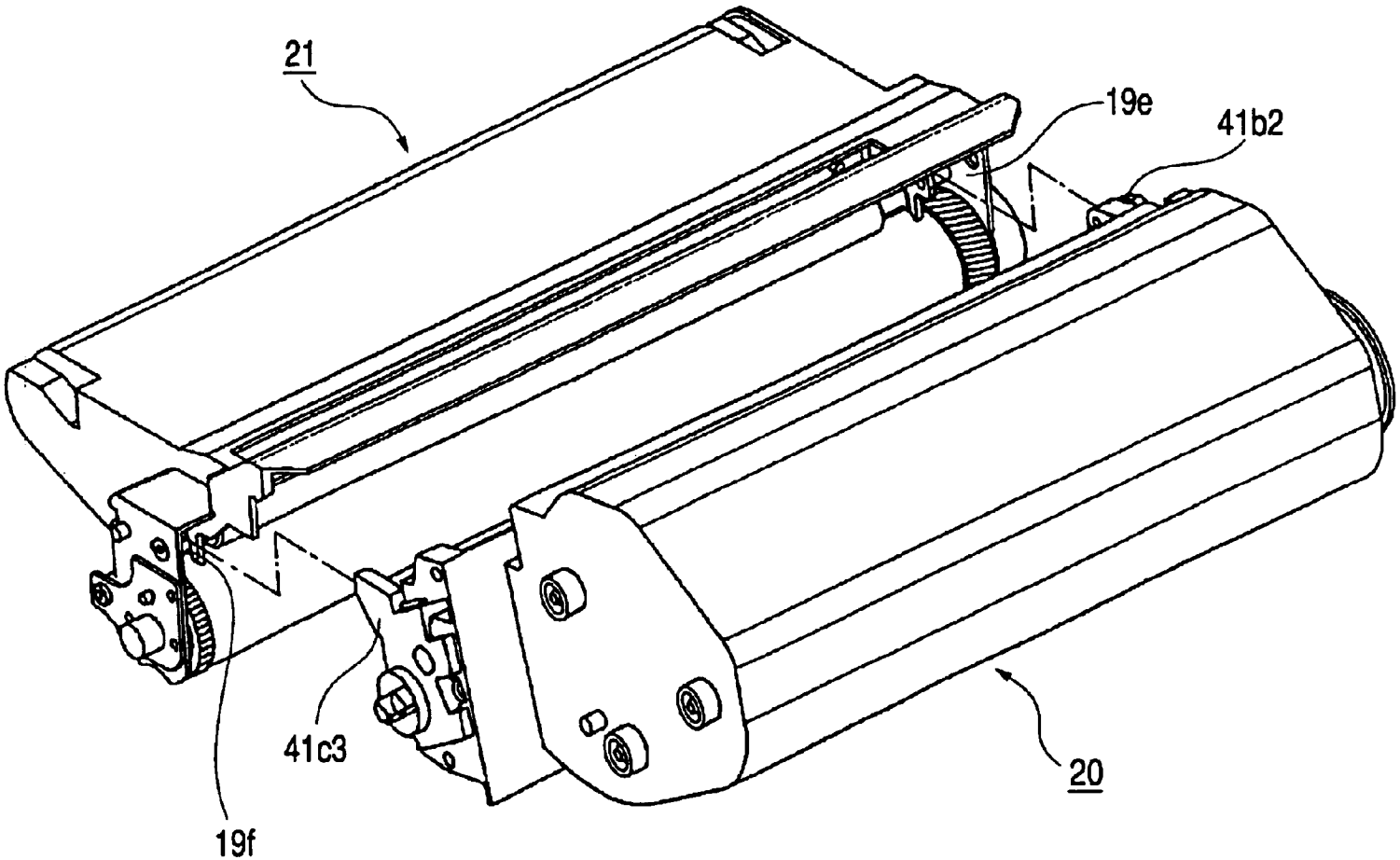
FIG. 11 is a perspective view showing how the photosensitive member unit and the developing unit are coupled with each other according to the embodiment of the present invention.

Hereinbelow, FIGS. 9 to 11 are referenced to describe a structure for coupling the photosensitive member unit 21 with the developing unit 20. FIGS. 9 and 10 are exploded perspective views showing how side covers are attached to the cartridge B according to the embodiment of the present invention. FIG. 11 is a perspective view showing a state where the photosensitive member unit 21 and the developing unit 20 are coupled with each other according to the embodiment of the present invention.

As shown in FIG. 11, the positions of the photosensitive member unit 21 and the developing unit 20 are temporarily determined by fitting the rocking arm 41*b*2 and the guide rib 41*c*3 into a guide portion 19*e* and a guide portion 19*f*, respectively. After that, the photosensitive member unit 21 and the developing unit 20 are coupled with each other by supporting both end portions thereof in a longitudinal direction with side covers 22 and 23 serving as coupling frames.

The side cover 22 on one side is provided with a reference hole 22*a* for fitting a cylindrical portion 24*a* of the drum bearing 24 that rotatably supports the gear flange 7*a* of the photosensitive drum 7, a reference boss 22*b* to be fitted into a reference hole 20*a* (see FIG. 7) of the developing unit 20, and a plurality of screw fixing portions arranged so as to correspond to screw holes that are formed in the side plate 19*a* of the drum frame 19 of the photosensitive member unit 21 and in a side surface of the toner containing frame 40 of the developing unit 20.

Therefore, the position of the side cover 22 is set with respect to the photosensitive member unit 21 by fitting the cylindrical portion 24*a* of the drum bearing 24 into the reference hole 22*a*. Thus, the position of the side cover 22 is determined in a direction perpendicular to the longitudinal direction of the photosensitive drum 7. Also, the attachment with the screws 28 brings a screw hole end surface 19*c* of the drum frame 19 into abutment with screw hole bearing surfaces 22*d* of the side cover 22, determining the position of the photosensitive member unit 21 in the longitudinal direction. Similarly, by fitting the reference boss 22*b* of the side cover 22 into the reference hole 20*a* of the developing unit 20, the position of the developing unit 20 is determined in the direction perpendicular to the longitudinal direction of the photosensitive drum 7. Further, the attachment with the screws 28 brings a screw hole end surface 20*c* of the developing unit 20 into abutment with a screw hole bearing surface 22*e* of the side cover 22, determining the position of the developing unit 20 in the longitudinal direction.

The side cover 23 on the other side is provided with a reference hole 23*a* for fitting a cylindrical portion 25*a* of the drum shaft 25 that rotatably supports the gear flange 7*b* of the photosensitive drum 7, a reference boss 23*b* to be fitted into a reference hole 20*b* of the developing unit 20, and a screw fixing portion arranged so as to correspond to screw holes that are formed in the side plate 19*b* of the drum frame 19 of the photosensitive member unit 21. The position of the side cover 23 is set with respect to the photosensitive member unit 21 by fitting the cylindrical portion 25*a* of the drum shaft 25 into the reference hole 23*a*, and thus determined in the direction perpendicular to the longitudinal direction of the photosensitive drum 7. Also, the attachment with the screws 28 brings a screw hole end surface 19*d* of the drum frame 19 into abutment with screw hole bearing surfaces 23*d* of the side cover 23, determining the position of the photosensitive member unit 21 in the longitudinal direction.

(Joining Side Covers to Developing Unit with Resin)

Figure 12:
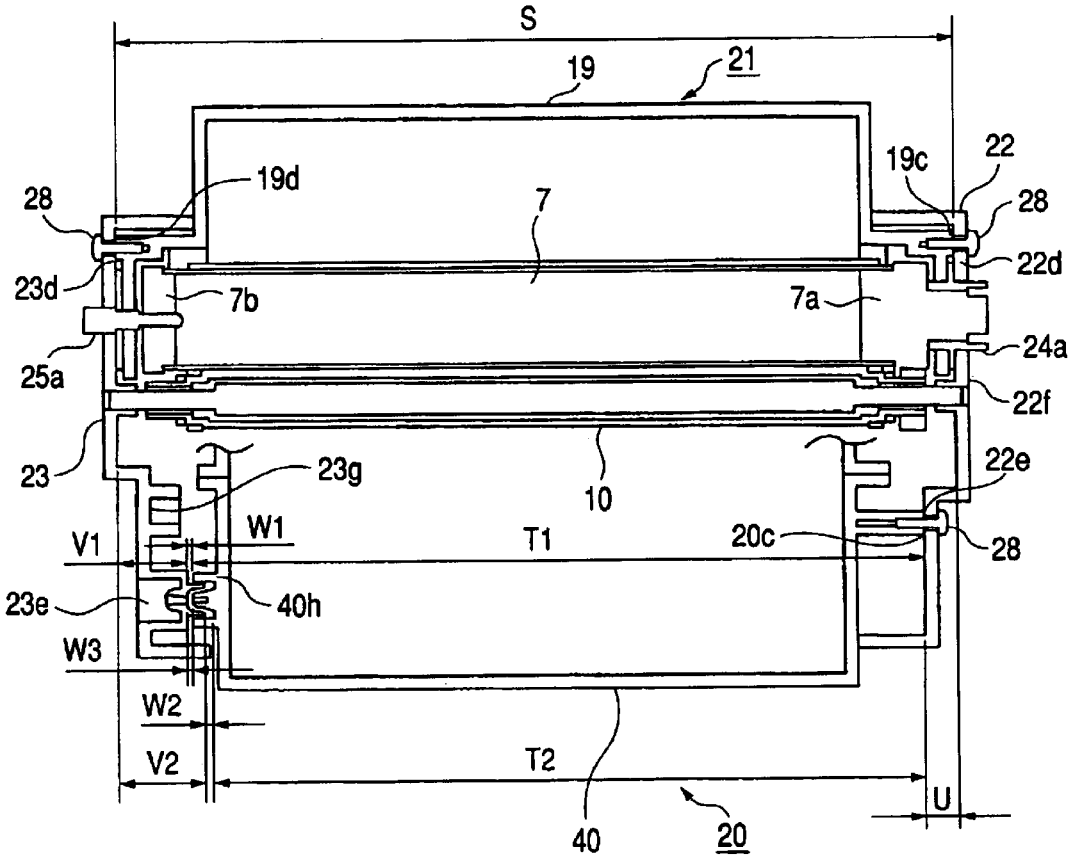
FIG. 12 is a horizontal cross-sectional view of the process cartridge according to the embodiment of the present invention.
Figure 13:
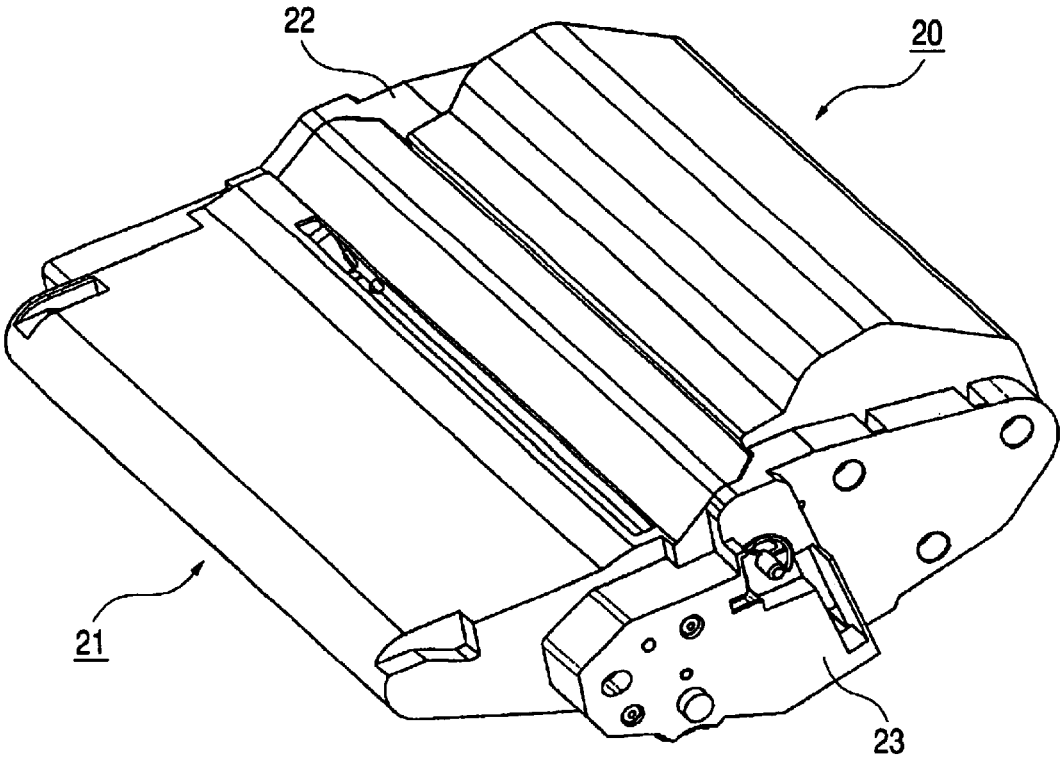
FIG. 13 is an overall perspective view of the process cartridge according to the embodiment of the present invention.

Next, FIGS. 9, 10, 12, and 13 are referenced to describe how the side cover 23 is joined to the developing unit 20 with a resin. FIG. 12 is a horizontal cross-sectional view of the process cartridge according to the embodiment of the present invention. FIG. 13 is an overall perspective view of the process cartridge according to the embodiment of the present invention.

As shown in FIGS. 9, 10, and 12, resin junctions 23*e* and resin junctions 40*h* which fixedly couples the two members with each other are provided to the side cover 23 and the toner containing frame 40 of the developing unit 20, respectively. Molten resins are injected into clearances between the resin junctions 23*e* and the resin junctions 40*h* to fix the side cover 23 and the toner containing frame 40. A step of joining the two members will be described later.

By fitting the reference boss 23*b* of the side cover 23 into the reference hole 20*b* of the developing unit 20, the position of the developing unit 20 is determined in the direction perpendicular to the longitudinal direction of the photosensitive drum 7. At this time, variations in dimensions shown in FIG. 12 including a longitudinal dimension S of the drum frame 19, longitudinal dimensions T1 and T2 of the developing unit 20, a step dimension U of the side cover 22, and step dimensions V1 and V2 of the side cover 23 are taken into consideration to arrange the resin junctions 23*e* of the side cover 23 and the resin junctions 40*h* of the developing unit 20 with clearances W1 and W2 therebetween. Then, the resin junctions 23*e* and the resin junctions 40*h* are fixed to each other through the joining step described below to fix the side cover 23 to the developing unit 20.

In its assembly steps, the cartridge B is fixed to a jig (not shown) or the like while the side cover 22 is fixed to the photosensitive member unit 21 and the developing unit 20, and the side cover 23 is fixed to the photosensitive member unit 21. In this embodiment, a side surface 22*f* of the side cover 22 is fixedly abutted against the jig, and a receiving surface 23*g* of a junction receiving portion 23*f* of the side cover 23 are abutted against the jig, determining the position of the side cover 23. At this time, as described above, the resin junctions 23*e* of the side cover 23 and the resin junctions 40*h* of the developing unit 20 have the clearances W1 and W2 therebetween, respectively. While the members are fixed as described above, the molten resins are injected from the resin junctions 23*e* of the side cover 23 to thereby fix the side cover 23 to the developing unit 20. Thus, the assembly of the cartridge B is completed.

Figure 14C:
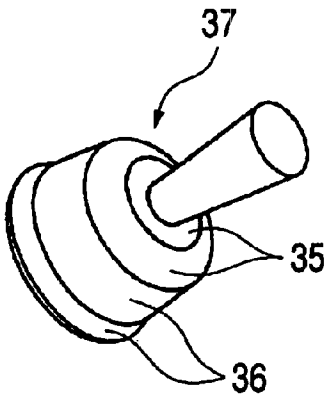
FIG. 14C is a perspective view showing a shape of an injected bonding resin.
Figure 14B:
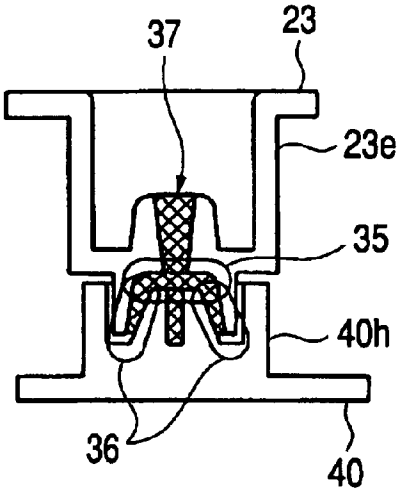
FIG. 14B is a cross-sectional view of a state where a molten resin is injected between the junctions.
Figure 14A:
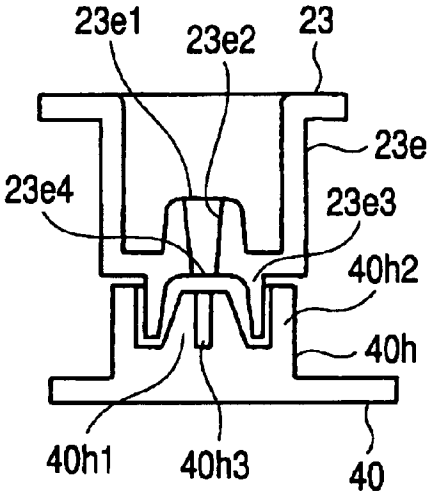
FIG. 14A is a cross-sectional view of junctions.

Next, FIGS. 14A, 14B, and 14C are referenced to describe a structure of the resin junctions. FIG. 14A is a cross-sectional view of junctions; FIG. 14B is a cross-sectional view of a state where the molten resin is injected between the junctions; and FIG. 14C is a perspective view showing a shape of the injected bonding resin.

As shown in FIG. 14A, the resin junction 23*e* of the side cover 23 has an injecting port 23*e*1 and an injecting flow path 23*e*2 which serve to inject the molten resin, and a projection 23*e*3 having a substantially cylindrical shape and forming a junction. Also, the resin junction 40*h* of the toner containing frame 40 of the developing unit 20 has a projection 40*h*1 forming a junction, a lightening hole 40*h*3 formed thereto, and a cylindrical portion 40*h*2 having an inner diameter larger than an outer diameter of the projection 23*e*3 of the side cover 23.

A molten resin 37 for joining the side cover 23 and the developing unit 20 is injected from the injecting port 23*e*1 of the side cover 23. The injected molten resin 37 passes through the injecting flow path 23*e*2 to reach a downstream opening 23*e*4, and then forms a first junction 35 that extends over a disk-like plane perpendicular to the injecting flow path 23*e*2. After that, the molten resin 37 forms a second junction 36 between an inner periphery of the projection 23*e*3 and an outer periphery of the projection 40*h*1. As a result, the injected molten resin 37 takes a shape as shown in FIG. 14B, firmly fixing the side cover 23 and the toner containing frame 40 of the developing unit 20. In this embodiment, as the materials of the two frames to be joined, that is, the side cover 23 and the toner containing frame 40, a high impact polystyrene (HIPS) is used. The HIPS material is also used for the resin to be injected. The materials are not limited thereto, and a resin compatible with a resin of a frame to be joined is used for the resin to be injected. Thus, the joining can be effectively performed and the members can be firmly fixed to each other so as not to be separated even upon impact during physical distribution or upon drop impact.

<Disassembling and Remanufacturing Methods for Cartridge>

Figure 1:
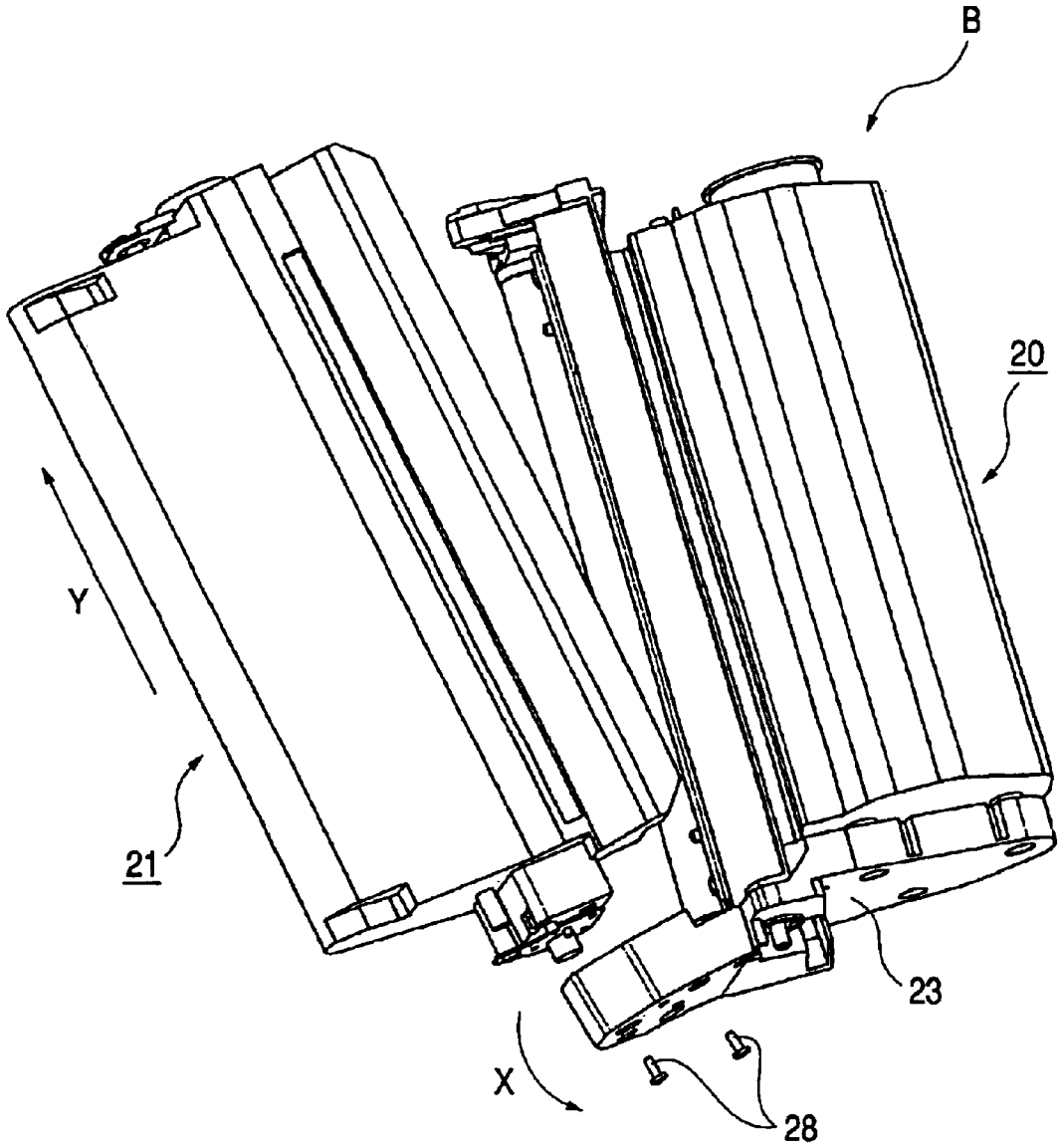
FIG. 1 is a perspective view showing how a photosensitive member unit is separated from a process cartridge according to an embodiment of the present invention.

Hereinafter, the accompanied drawings are referenced to describe disassembling and remanufacturing methods for the cartridge B according to the embodiment of the present invention. FIG. 1 is a perspective view showing how a photosensitive member unit 21 is separated from the cartridge B according to the embodiment of the present invention.

(Frame Separating Step)

As shown in FIG. 1, the side cover 22 fastened with the screws is removed from the cartridge B. After that, the screws 28 that couple the side cover 23 and the photosensitive member unit 21 are unfastened.

(Photosensitive Member Unit Separating Step)

As described above, the photosensitive member unit 21 and the developing unit 20 have the guide portion 19*f* and the guide rib 41*c*3, respectively. The guide portion 19*f* and the guide rib 41*c*3 are fitted into each other, regulating their positions in the longitudinal direction. Further, their positions are regulated in a transverse direction by the side cover 23. Therefore, the photosensitive member unit 21 and the developing unit 20 cannot easily be separated as they are. Thus, the side cover 23 made of a mold resin is deformed in a direction X of FIG. 1 so as to separate fitted portions between the side cover 23 and the photosensitive member unit 21. Then, the photosensitive member unit 21 is pulled out in a direction Y of FIG. 1 to separate the photosensitive member unit 21 from the developing unit 20 (which is coupled to the side cover 23 with resins). Therefore, by deforming the side cover 23 made of the mold resin utilizing the elasticity thereof, the photosensitive member unit 21 and the developing unit 20 can be separated from each other while avoiding the breakage of the above-mentioned resin junctions or the breakage of the side cover 23. Accordingly, it becomes easier to remanufacture the cartridge B.

(Developer Filling Step for Developing Unit)

Figure 15:
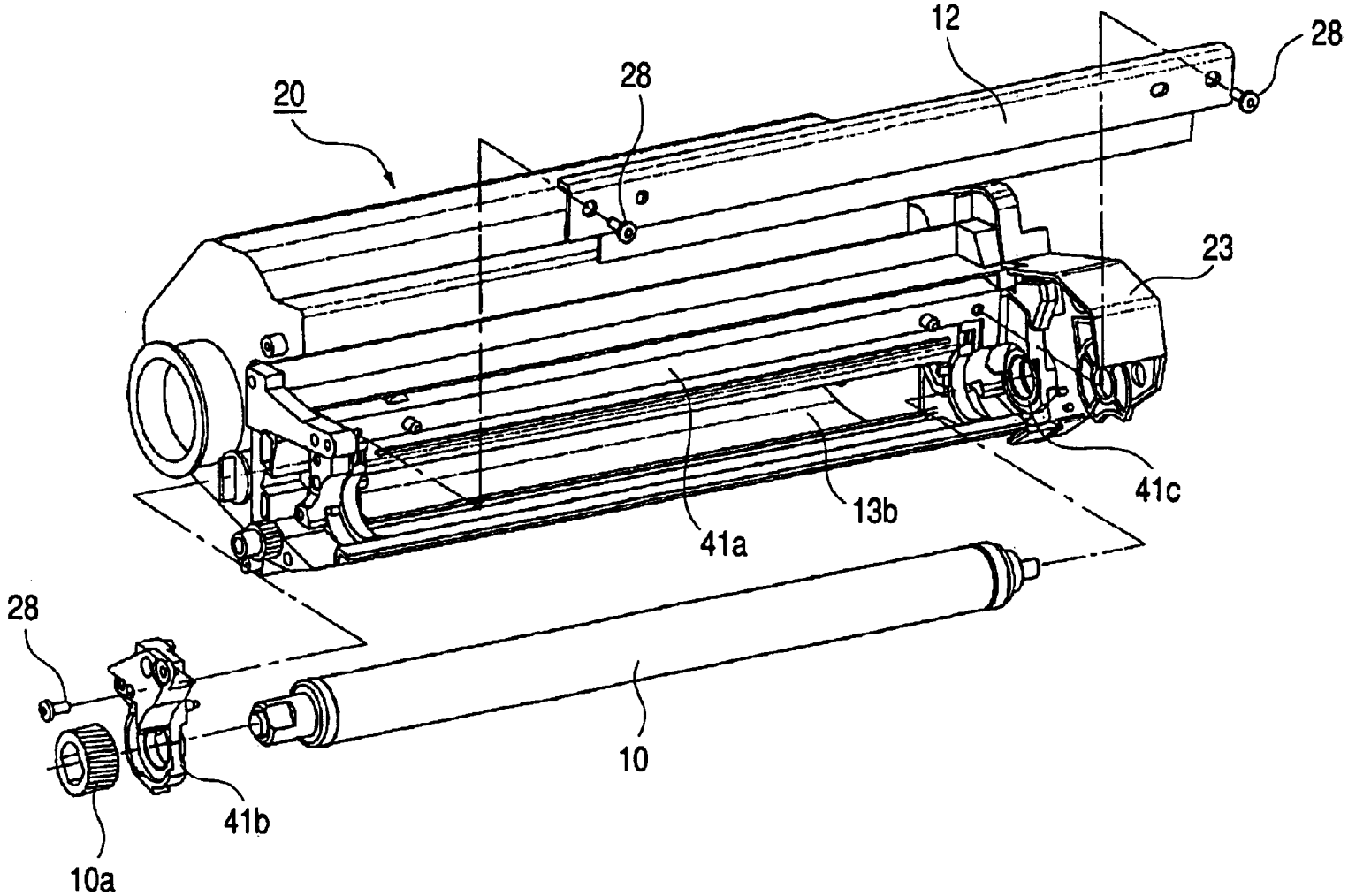
FIG. 15 is an exploded perspective view showing how the developing unit is disassembled or remanufactured according to the embodiment of the present invention.

Next, FIG. 15 is referenced to describe a disassembling step for the separated developing unit 20. FIG. 15 is an exploded perspective view showing how the developing unit is disassembled or remanufactured according to the embodiment of the present invention.

As shown in FIG. 15, the drive gear 10*a* is detached from the developing unit 20 (which is coupled to the side cover 23) separated from the photosensitive member unit 21. Then, the screw 28 that fixes the second frame 41*b* is unfastened, and the second frame 41*b* is caused to slide in the longitudinal direction to be detached from the developing unit 20. The developing roller 10 whose supporting portion on one side has been removed due to the detachment of the second frame 41*b* is caused to slide in the longitudinal direction to be taken out from the third frame 41*c* that is coupled to the first frame 41*a*. After that, the developing blade 12 fixed to the first frame 41*a* at two positions in the longitudinal direction using the screws is removed. According to the above-mentioned step, the developing unit 20 can be disassembled.

Figure 16:
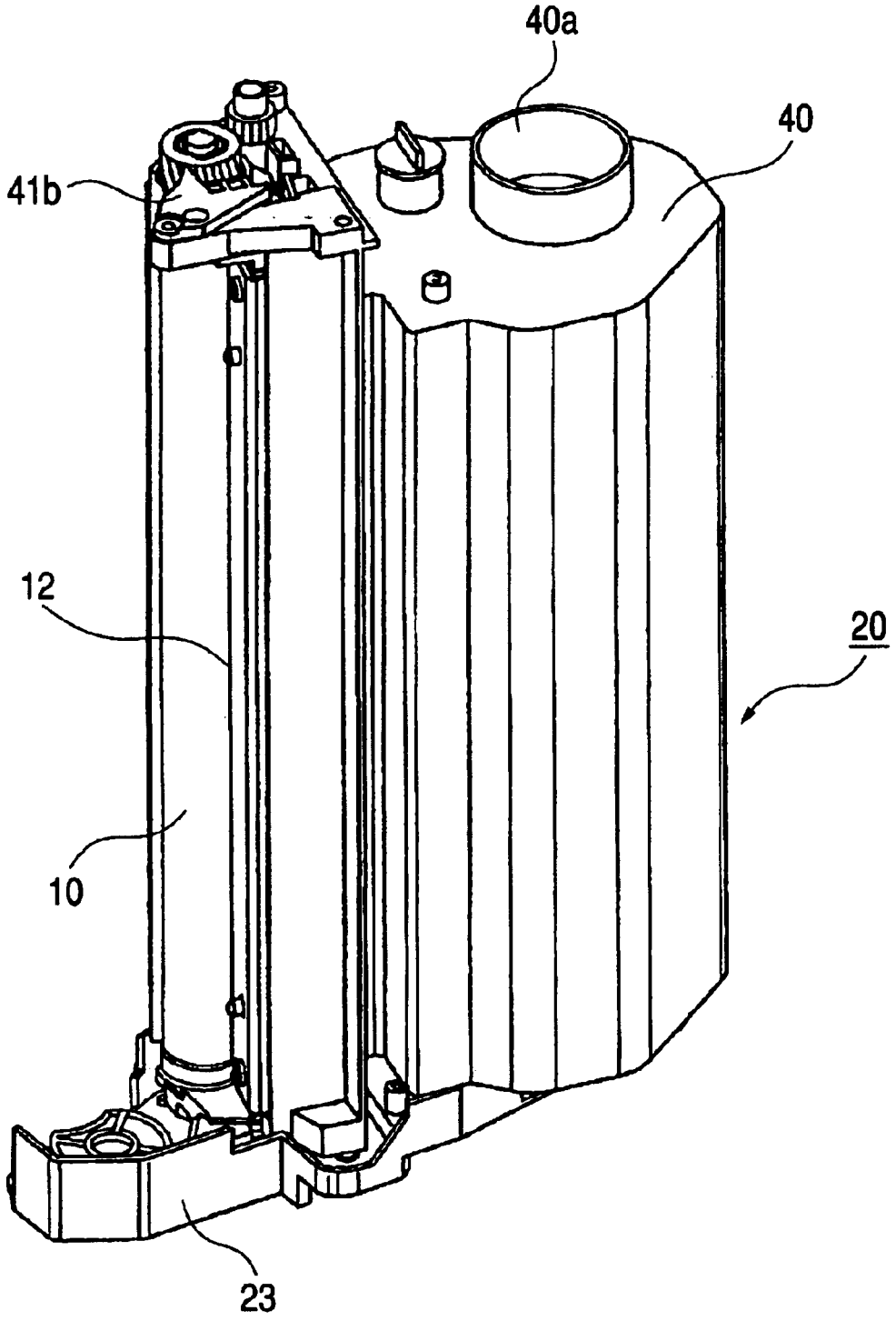
FIG. 16 is a perspective view for explaining how the developing unit is refilled with toner according to the embodiment of the present invention.

Next, FIGS. 15 and 16 are referenced to describe a remanufacturing step for the disassembled developing unit 20. FIG. 16 is a perspective view for explaining how the developing unit is filled with toner according to the embodiment of the present invention.

From the toner supplying opening 13*b* (see FIG. 15) that is exposed to the outside after the developing roller 10 and the developing blade 12 have been removed, the developing unit 20 is cleaned of the residual toner by suction, air blowing, or the like. Then, with the toner supplying opening 13*b* of the developing unit 20 facing upward, new toner is poured through the toner supplying opening 13*b* to fill the developing unit 20. After the toner filling, a re-sealing step is performed by closing the toner supplying opening 13*b* with a new developer seal member. Note that the re-sealing step for the toner supplying opening 13*b* may not necessarily be performed, and the remanufacturing is possible even without performing the re-sealing step. Also, in the case where the developing blade 12 is not replaced, the toner filling can be performed without removing the developing blade 12.

After completing the toner filling and the re-sealing for the toner supplying opening 13*b*, a procedure reverse to that used in the disassembling step is followed. That is, the developing blade 12 is fixed to the first frame 41*a* at two positions in the longitudinal direction using the screws 28. Then, a new developing roller 10 is incorporated into the developing unit 20, and the second frame 41*b* is fixed to the first frame 41*a* with the screw 28. Thus, the developing unit 20 is remanufactured.

Note that in the case where the developing blade 12 and the developing roller 10 which are to be attached to the developing unit 20 again are not replaced with new ones, a cleaning step and an inspection step which are described below can be added.

Before being attached to the developing unit 20, the developing blade 12 and the developing roller 10 are cleaned of the adhering toner by air suction simultaneously with air blowing or the like. After the cleaning, the inspection is performed to judge whether or not the members are reusable after the remanufacturing. As a result of the inspection, if determined to be reusable, the members are assembled as they are. Alternatively, as a result of the inspection, if the performances do not meet predetermined criteria, the members are appropriately replaced with new ones.

Further, as to the toner filling step, instead of the method of filling the developing unit 20 with toner through the toner supplying opening 13*b*, the following method may be used. That is, as shown in FIG. 16, the toner cap 40*a*1 (see FIG. 5) is detached from the toner filling port 40*a* of the toner containing frame 40, which is exposed to the outside by removing the side cover 22, to refill the developing unit 20 with toner. After the toner refilling, the toner filling port 40*a* is re-sealed with the toner cap 40*a*1. In this case, it is necessary to perform the above step in the state where the developing blade 12 and the developing roller 10 are incorporated into the developing unit 20, or to close the toner supplying opening 13*b* with a new developer seal member in advance.

(Photosensitive Drum Detaching Step and Photosensitive Drum Attaching Step)

Figure 17:
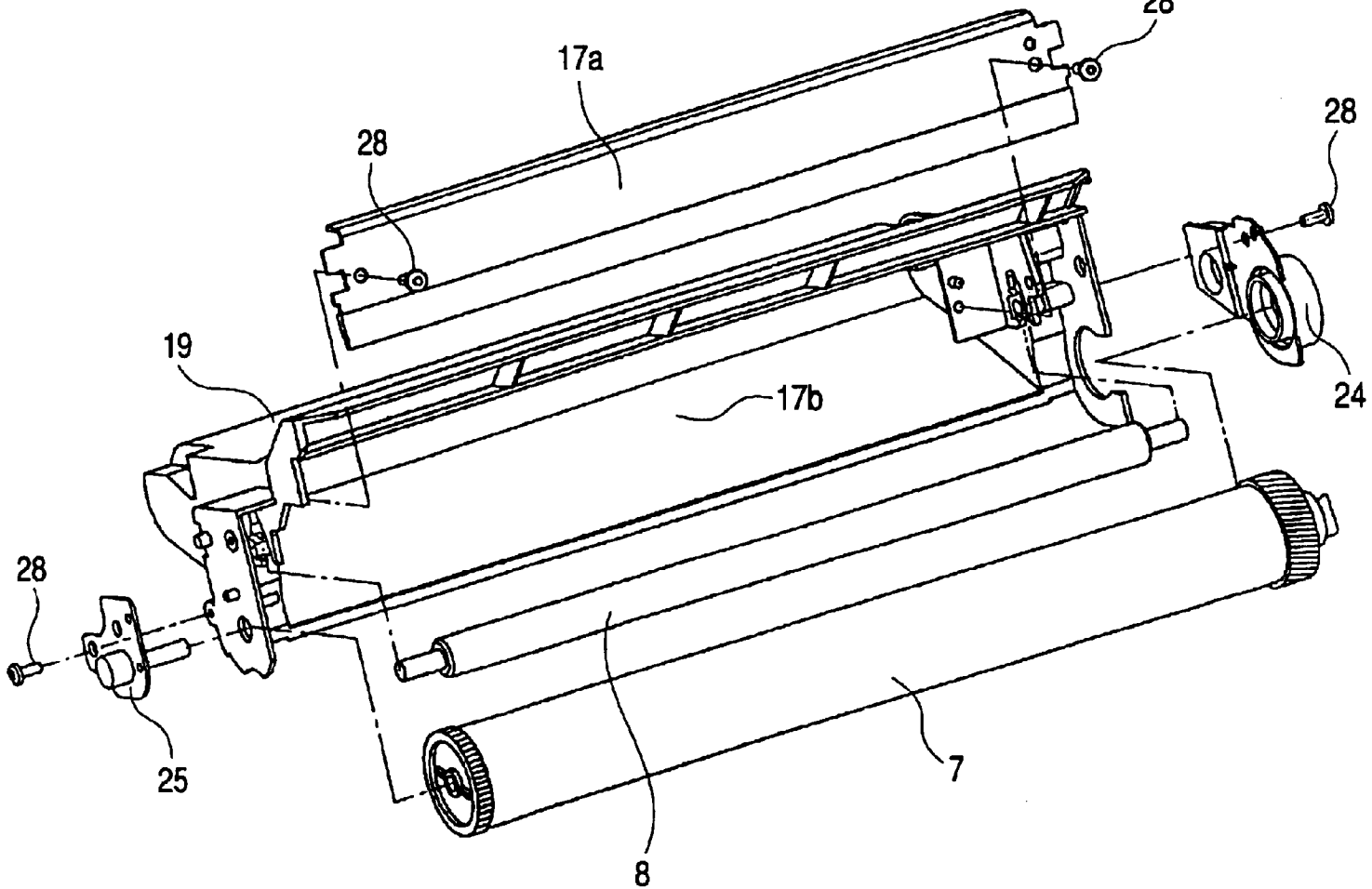
FIG. 17 is an exploded perspective view showing how the photosensitive member unit is disassembled or remanufactured according to the embodiment of the present invention.

Next, FIG. 17 is referenced to describe a disassembling step for the photosensitive member unit 21 separated from the cartridge B. FIG. 17 is an exploded perspective view showing how the photosensitive member unit is disassembled or remanufactured according to the embodiment of the present invention.

The screws 28 on both end portions of the photosensitive member unit 21 are unfastened. Then, the drum bearing 24 and the drum shaft 25 which support the photosensitive drum 7 are detached. Thus, the photosensitive drum 7 is detached from the photosensitive member unit 21.

Subsequently, the charging roller 8 is detached from the photosensitive member unit 21. Then, the screws 28 that fix the cleaning blade 17*a* to the drum frame 19 are unfastened. After that, the blade 17*a* is detached from the photosensitive member unit 21. By performing the above-mentioned step, the disassembling of the photosensitive member unit 21 is completed.

Next, FIG. 17 is referenced to describe a remanufacturing step for the disassembled photosensitive member unit 21.

The blade 17*a* is detached, and the exposed waste toner reservoir 17*b* is cleaned of waste toner by suction, air blowing, or the like. After completing the waste toner cleaning a procedure reverse to that used in the disassembling step is followed. That is, a new blade 17*a* is fixed to the photosensitive member unit 21 at two positions in the longitudinal direction using the screws 28. Then, the charging roller 8 is incorporated into the photosensitive member unit 21, and a new photosensitive drum 7 is attached to the photosensitive member unit 21. After that, the drum bearing 24 and the drum shaft 25 are fixed to the photosensitive drum 7 with the screws 28 from both sides thereof. Thus, the photosensitive member unit 21 is remanufactured.

Described above are examples of using brand-new consumable parts such as the photosensitive drum 7, the charging roller 8, and the blade 17*a*. However, if judged as reusable after the inspection, the detached parts can be cleaned, incorporated to the developing unit 20, and reused.

Note that either the disassembling step and remanufacturing step for the developing unit 20, or the disassembling step and remanufacturing step for the photosensitive member unit 21 may be performed first.

(Photosensitive Member Unit Engaging Step)

The photosensitive member unit 21 and the developing unit 20, which have been remanufactured as described above, are again coupled to each other by following a procedure reverse to the procedure used in the separating step. That is, as shown in FIG. 1, by deforming the side cover 23, the guide rib 41*c*3 is inserted into the above-mentioned guide portion 19*f*. Then, the photosensitive member unit 21 and the developing unit 20 are again coupled to the side cover 23 with the screws. At this time, if the guide rib 41*c*3 of the developing unit 20 is cut off in advance, the coupling can be performed without deforming the side cover 23.

Then, the side cover 22 is fitted into the photosensitive member unit 21 and the developing unit 20, and fixed thereto with the screws. Thus, both sides of the photosensitive member unit 21 and the developing unit 20 are fixed by the side covers 22 and 23. Accordingly, the cartridge B can be remanufactured.

The remanufacturing method according to the present invention has been shown taking as an example the remanufacturing of the cartridge that utilizes the junction made of the molten resin for fixing the side cover 23 to the developing unit 20. However, the remanufacturing method is not limited thereto, and may be a coupling method using welding, caulking, or the like.

Further, even if it is not the developing unit 20 but the photosensitive member unit 21 to be joined to the side cover 23 with the molten resin, the remanufacturing method according to the present invention can be adopted.

Further, a description has been provided that the portions other than the junctions made of the molten resin are fastened and fixed with screws. However, as long as a plurality of parts can be fixed to each other, any methods may be adopted, and the parts may be the fixed by welding, caulking, or the like.

Note that the step order for the remanufacturing method according to the present invention is not limited to the step order described above, and may appropriately be changed.

The above-mentioned embodiment includes the following two cases. In one case, the process cartridges that have been used are collected and disassembled. Then, parts detached from the respective process cartridges by the disassembling are collected into groups of the same parts. After that, using the parts, or in some cases, partially using new ones of the parts (parts that are not to be reused), the process cartridge is remanufactured by the above-mentioned remanufacturing method. In the other case, the process cartridge that has been used is collected and disassembled. Then, using the parts detached from the cartridge, or in some cases, partially using new ones of the parts (parts that are not to be reused) or the parts detached from another cartridge, the process cartridge is remanufactured by the above-mentioned remanufacturing method.

Further, the embodiment of the present invention includes the following aspects.

(First Aspect)

A remanufacturing method is for a process cartridge B detachably attachable to a main body of an image forming apparatus A. The process cartridge includes:

a photosensitive member unit 21 having an electrophotographic photosensitive drum 7 on which an electrostatic latent image is formed;

a developing unit 20 having: a developer container (toner containing frame 40) for containing a developer for developing the electrostatic latent image; and a developing roller 10 for carrying the developer;

a first coupling frame (side cover 22) for coupling one end side of the photosensitive member unit 21 and one end side of the developing unit 20 to each other; and a second coupling frame (side cover 23) for coupling the other end side of the photosensitive member unit 21 and the other end side of the developing unit 20, which are opposite sides of the one end sides, to each other.

The remanufacturing method includes:

(a) a frame separating step for separating the first coupling frame (side cover 22) from the developing unit 20 and the photosensitive member unit 21;

(b) a photosensitive member unit separating step for, after the frame separating step, separating the photosensitive member unit 21 by deforming the second coupling frame (side cover 23) in a state where the second coupling frame (side cover 23) and the photosensitive member unit 21 are fixed to each other;

(c) a photosensitive drum detaching step for, after the photosensitive member unit separating step, detaching the electrophotographic photosensitive drum 7 from the photosensitive member unit 21;

(d) a photosensitive drum attaching step for, after the photosensitive drum detaching step, attaching one of the electrophotographic photosensitive drum 7 and a new photosensitive drum;

(e) a photosensitive member unit engaging step for engaging the photosensitive member unit 21 with the second coupling frame (side cover 23) that is fixed to the developing unit 20; and (f) a frame engaging step for engaging the first coupling frame (side cover 22) with respective end portions of the developing unit 20 and the photosensitive member unit 21.

(Second Aspect)

A remanufacturing method is for a process cartridge B detachably attachable to a main body of an image forming apparatus A. The process cartridge includes:

a photosensitive member unit 21 having an electrophotographic photosensitive drum 7 on which an electrostatic latent image is formed;

a developing unit 20 having: a developer container (toner containing frame 40) for containing a developer for developing the electrostatic latent image; and a developing roller 10 for carrying the developer;

a first coupling frame (side cover 22) for coupling one end side of the photosensitive member unit 21 and one end side of the developing unit 20 to each other; and a second coupling frame (side cover 23) for coupling the other end side of the photosensitive member unit 21 and the other end side of the developing unit 20, which are opposite sides of the one end sides, to each other.

The developing unit 20 and the second coupling frame (side cover 23) are fixed to each other with an injected molten resin 37.

The photosensitive member unit 21 and the second coupling frame (side cover 23) are fastened to each other with a fastening member (screw 28).

The remanufacturing method includes:

(a) a frame separating step for separating the first coupling frame (side cover 22) from the developing unit 20 and the photosensitive member unit 21;

(b) a fastening releasing step for releasing fastening of the photosensitive member unit 21 to the second coupling frame (side cover 23);

(c) a photosensitive member separating step for, after the fastening releasing step, separating the developing unit 20 and the photosensitive member unit 21 from each other by deforming the second coupling frame (side cover 23) in a state where the developing unit 20 and the second coupling frame (side cover 23) are fixed to each other;

(d) a photosensitive drum detaching step for, after the photosensitive member unit separating step, detaching the electrophotographic photosensitive drum 7 from the photosensitive member unit 21;

(e) a photosensitive drum attaching step for, after the photosensitive drum detaching step, attaching one of the electrophotographic photosensitive drum 7 and a new photosensitive drum;

(f) a photosensitive member unit engaging step for engaging the photosensitive member unit 21 with the second coupling frame (side cover 23) that is fixed to the developing unit 20; and (g) a frame engaging step for engaging the first coupling frame (side cover 22) with respective end portions of the developing unit 20 and the photosensitive member unit 21.

(Third Aspect)

A remanufacturing method is for a process cartridge B detachably attachable to a main body of an image forming apparatus A. The process cartridge includes:

a photosensitive member unit 21 having an electrophotographic photosensitive drum 7 on which an electrostatic latent image is formed;

a developing unit 20 having: a developer container (toner containing frame 40) for containing a developer for developing the electrostatic latent image; and a developing roller 10 for carrying the developer;

a second coupling frame (side cover 23) or coupling the other end side of the photosensitive member unit 21 and the other end side of the developing unit 20, which are opposite sides of the one end sides, to each other.

The photosensitive member unit 21 and the second coupling frame (side cover 23) are fixed to each other with an injected molten resin 37.

The developing unit 20 and the second coupling frame (side cover 23) are fastened to each other with a fastening member (screws 28).

The remanufacturing method includes:

(a) a frame separating step for separating the first coupling frame (side cover 22) from the photosensitive member unit 21 and the developing unit 20;

(b) a fastening releasing step for releasing fastening of the second coupling frame (side cover 23) to the developing unit 20;

(c) a developing unit separating step for, after the fastening releasing step, separating the photosensitive member unit 21 and the developing unit 20 from each other by deforming the second coupling frame (side cover 23) in a state where the photosensitive member unit 21 and the second coupling frame (side cover 23) are fixed to each other;

(d) a photosensitive drum detaching step for, after the developing unit separating step, detaching the electrophotographic photosensitive drum 7 from the photosensitive member unit 21;

(e) a photosensitive drum attaching step for, after the photosensitive drum detaching step, attaching one of the electrophotographic photosensitive drum 7 and a new photosensitive drum;

(f) a developing unit engaging step for engaging the developing unit 20 with the second coupling frame (side cover 23) that is fixed to the photosensitive member unit 21; and (g) a frame engaging step for engaging the first coupling frame (side cover 22) with respective end portions of the photosensitive member unit 21 and the developing unit 20.

(Fourth Aspect)

A remanufacturing method for a process cartridge according to the first, second, or third aspect, further including a developer refilling step for, before the photosensitive member unit 21 engaging step or the developing unit engaging step, refilling the developer container (toner containing frame 40) with the developer from a developer supplying opening (toner supplying opening 13*b*) exposed by detaching the developing roller 10 from the developing unit 20.

(Fifth Aspect)

A remanufacturing method is for a process cartridge according to any one of the first to third aspects. The method further includes a developer refilling step for, before the frame engaging step, refilling the developer container (toner containing frame 40) with the developer from a developer filling port (toner filling port 40*a*) that is provided to the developer container (toner containing frame 40) for filling of a developer.

According to the above-mentioned remanufacturing method, the cartridge B that has been used is collected. Then, while maintaining the state where the developing unit and the second frame are fixed to each other, the developer container can be filled with the developer easily. Also, the electrophotographic photosensitive drum is replaced with a new one. Thus, the cartridge B that has lost the commercial value of the cartridge B becomes usable again, and is commercialized again. Accordingly, the frame of the cartridge B, the developing roller and the developing blade composing the developing unit, and the parts such as a gear for transmitting a driving force and a coupling can be used effectively.

The above-mentioned remanufacturing method is performed in all the cases described below.

(1) A case where only parts detached from one of cartridges are reused to remanufacture the cartridge.

(2) A case where parts, which cannot be reused in the above-mentioned case (1) because they have reached the end of their life, suffer damage, or the like, are replaced with new ones or reused parts detached from another cartridge to remanufacture the cartridge.

(3) A case where parts detached from a plurality of cartridges are collected into groups of the same parts, and necessary parts are selected from the groups of the same parts and reused to remanufacture the cartridge.

(4) A case where parts, which cannot be reused in the above-mentioned case (3) because they have reached the end of their life, suffer damage, or the like, are replaced with new ones to remanufacture the cartridge.

Note that the part represents a structure described in the appended claims, that is, a product that composes a certain portion of a cartridge. The part also includes a member unit and a minimum unit that cannot be disassembled any further.

As has been described above, according to the present invention, there can be provided a simplified remanufacturing method for a process cartridge.

Further, according to the present invention, there can be provided a simplified remanufacturing method for a process cartridge in which structural components are joined to each other by a molten resin, the remanufacturing method including no process for separating the portions joined with the molten resin.

While the invention has been described with reference to the structure disclosed herein, it is not confined to the details set forth and this application is intended to cover such modifications or changes as may come within the purposes of the improvements or the scope of the following claims.

What is claimed is:

1. A method of remanufacturing a process cartridge detachably attachable to an image forming apparatus main body, the process cartridge including a photosensitive member unit having an electrophotographic photosensitive drum on which an electrostatic latent image is formed, a developing unit having a developer container for containing a developer for developing the electrostatic latent image and a developing roller configured and positioned to carry the developer, a first coupling frame configured and positioned to couple one end side of the photosensitive member unit and one end side of the developing unit to each other, and a second coupling frame configured and positioned to couple the other end side of the photosensitive member unit and the other end side of the developing unit, which are opposite sides of the one end sides, to each other, said method comprising:

(a) a frame separating step for separating the first coupling frame from the developing unit and from the photosensitive member unit;

(b) a photosensitive member unit separating step for, after said frame separating step, separating the photosensitive member unit from the second coupling frame by deforming the second coupling frame in a state where the second coupling frame and the developing unit are fixed to each other;

(c) a photosensitive drum detaching step for, after said photosensitive member unit separating step, detaching the electrophotographic photosensitive drum from the photosensitive member unit;

(d) a photosensitive drum attaching step for, after said photosensitive drum detaching step, attaching one of the electrophotographic photosensitive drum and a new photosensitive drum;

(e) a photosensitive member unit engaging step for engaging the photosensitive member unit with the second coupling frame that is fixed to the developing unit; and (f) a frame engaging step for engaging the first coupling frame with respective end portions of the developing unit and the photosensitive member unit.

2. A method of remanufacturing a process cartridge detachably attachable to an image forming apparatus main body, the process cartridge including a photosensitive member unit having an electrophotographic photosensitive drum on which an electrostatic latent image is formed, a developing unit having a developer container for containing a developer for developing the electrostatic latent image, and a developing roller configured and positioned to carry the developer, a first coupling frame configured and positioned to couple one end side of the photosensitive member unit and one end side of the developing unit to each other, and a second coupling frame configured and positioned to couple the other end side of the photosensitive member unit and the other end side of the developing unit, which are opposite sides of the one end sides, to each other, the developing unit and the second coupling frame being fixed to each other with an injected molten resin, the photosensitive member unit and the second coupling frame being fastened to each other with a fastening member, said method comprising:

(a) a frame separating step for separating the first coupling frame from the developing unit and the photosensitive member unit;

(b) a fastening releasing step for releasing fastening of the photosensitive member unit to the second coupling frame;

(c) a photosensitive member unit separating step for, after said fastening releasing step, separating the developing unit and the photosensitive member unit from each other by deforming the second coupling frame in a state where the developing unit and the second coupling frame are fixed to each other;

(d) a photosensitive drum detaching step for, after said photosensitive member unit separating step, detaching the electrophotographic photosensitive drum from the photosensitive member unit;

(e) a photosensitive drum attaching step for, after said photosensitive drum detaching step, attaching one of the electrophotographic photosensitive drum and a new photosensitive drum;

(f) a photosensitive member unit engaging step for engaging the photosensitive member unit with the second coupling frame that is fixed to the developing unit; and (g) a frame engaging step for engaging the first coupling frame with respective end portions of the developing unit and the photosensitive member unit.

3. A method of remanufacturing a process cartridge detachably attachable to an image forming apparatus main body, the process cartridge including a photosensitive member unit having an electrophotographic photosensitive drum on which an electrostatic latent image is formed, a developing unit having a developer container for containing a developer for developing the electrostatic latent image, a developing roller configured and positioned to carry the developer, a first coupling frame configured and positioned to couple one end side of the photosensitive member unit and one end side of the developing unit to each other, and a second coupling frame configured and positioned to couple the other end side of the photosensitive member unit and the other end side of the developing unit, which are opposite sides of the one end sides, to each other, the photosensitive member unit and the second coupling frame being fixed to each other with an injected molten resin, the developing unit and the second coupling frame being fastened to each other with a fastening member, said method comprising:

(a) a frame separating step for separating the first coupling frame from the photosensitive member unit and from the developing unit;

(b) a fastening releasing step for releasing fastening of the second coupling frame to the developing unit;

(c) a developing unit separating step for, after said fastening releasing step, separating the photosensitive member unit and the developing unit from each other by deforming the second coupling frame in a state where the photosensitive member unit and the second coupling frame are fixed to each other;

(d) a photosensitive drum detaching step for, after said developing unit separating step, detaching the electrophotographic photosensitive drum from the photosensitive member unit;

(e) a photosensitive drum attaching step for, after said photosensitive drum detaching step, attaching one of the electrophotographic photosensitive drum and a new photosensitive drum;

(f) a developing unit engaging step for engaging the developing unit with the second coupling frame that is fixed to the photosensitive member unit; and (g) a frame engaging step for engaging the first coupling frame with respective end portions of the photosensitive member unit and the developing unit.

4. A method of remanufacturing a process cartridge according to claim 1, 2, or 3, further comprising a developer refilling step for, before said unit engaging step, refilling the developer container with the developer from a developer supplying opening exposed by detaching the developing roller from the developing unit.

5. A method of remanufacturing a process cartridge according to claim 1, 2, or 3, further comprising a developer refilling step for, before said frame engaging step, refilling the developer container with the developer from a developer filling port that is provided to the developer container for filling of a developer.

* * * * *

UNITED STATES PATENT AND TRADEMARK OFFICE

CERTIFICATE OF CORRECTION

PATENT NO. : 6,941,092 B2
APPLICATION NO. : 10/697323
DATED : September 6, 2005
INVENTOR(S) : Akiyoshi Yokoi It is certified that error appears in the above-identified patent and that said Letters Patent is hereby corrected as shown below:

COLUMN 14

Line 4, "developer" should read --developer; (New Paragraph) a first coupling frame (side cover 22) for coupling one end side of the photosensitive member until 21 and one end side of the developing unit 20 to each other; and--.

Line 5, "or" should read --for--.

Signed and Sealed this

First Day of August, 2006

JON W. DUDAS

*Director of the United States Patent and Trademark Office*